US010851616B2

(12) United States Patent
Knight et al.

(10) Patent No.: US 10,851,616 B2
(45) Date of Patent: Dec. 1, 2020

(54) WIRELINE SUSPENDABLE APPARATUS FOR SEALING A SUBTERRANEAN WELL

(71) Applicants: Peter Knight, Calgary (CA); Grant George, Calgary (CA); Curtis Ring, Calgary (CA)

(72) Inventors: Peter Knight, Calgary (CA); Grant George, Calgary (CA); Curtis Ring, Calgary (CA)

( * ) Notice: Subject to any disclaimer, the term of this patent is extended or adjusted under 35 U.S.C. 154(b) by 0 days.

(21) Appl. No.: 16/198,561

(22) Filed: Nov. 21, 2018

(65) Prior Publication Data

US 2019/0169955 A1 Jun. 6, 2019

Related U.S. Application Data

(60) Provisional application No. 62/589,487, filed on Nov. 21, 2017.

(51) Int. Cl.

| | |
|---|---|
| ***E21B 33/13*** | (2006.01) |
| ***E21B 37/04*** | (2006.01) |
| ***E21B 34/06*** | (2006.01) |

(52) U.S. Cl.

CPC ..... *E21B 33/13* (2013.01); *E21B 34/063* (2013.01); *E21B 37/045* (2013.01); *E21B 2200/05* (2020.05)

(58) Field of Classification Search

CPC ..... E21B 33/13; E21B 34/063; E21B 37/045; E21B 2034/005

See application file for complete search history.

(56) References Cited

U.S. PATENT DOCUMENTS

| | | | |
|---|---|---|---|
| 4,809,779 | A | 3/1989 | Ledyashov et al. |
| 6,371,207 | B1 | 4/2002 | Reynolds |

(Continued)

FOREIGN PATENT DOCUMENTS

| | | |
|---|---|---|
| WO | 0138691 | 5/2001 |
| WO | 2007003894 | 1/2007 |
| WO | 2014083057 | 6/2014 |

OTHER PUBLICATIONS

International Searching Authority, The International Search Report and the Written Opinion of the International Searching Authority, or the Declaration, International Application No. PCT/CA2018/051481, Filed Nov. 21, 2018, 9 pages, Receiving Office—Canadian Intellectual Property Office.

*Primary Examiner* — Silvana C Runyan

(74) *Attorney, Agent, or Firm* — Richard D. Okimaw

(57) ABSTRACT

An apparatus and method for preparing a casing of a subterranean well and injecting a sealing mixture therein. The apparatus comprises an elongate body extending between top and bottom ends connectable to a wireline at the top and having a plurality of nozzles extending therethrough proximate to the bottom. A plurality of scrapers within the body each have a first retracted position and a second radially extended position engageable with the casing. A cavity is operable to contain the sealing mixture and a piston is movable therein so to eject the sealing mixture through the nozzles. The method comprises positioning the body in the well at a location to be sealed, extending the scrapers to engage with the casing, displacing the body so to scrape against the casing and retracting the scrapers. The piston is displaced so to eject the sealing mixture through the nozzles.

18 Claims, 36 Drawing Sheets

(56) References Cited

U.S. PATENT DOCUMENTS

| | | | | |
|---|---|---|---|---|
| 2002/0088619 | A1* | 7/2002 | Follini | E21B 7/061 166/285 |
| 2008/0283252 | A1* | 11/2008 | Guignard | E21B 33/124 166/381 |
| 2016/0230507 | A1* | 8/2016 | Cleven | E21B 33/124 |

* cited by examiner

WIRELINE SUSPENDABLE APPARATUS FOR SEALING A SUBTERRANEAN WELL

CROSS REFERENCE TO RELATED APPLICATION

This application claims priority to U.S. Provisional patent application Ser. No. 62/589,487 filed Nov. 21, 2017 entitled Subterranean Well Sealing Injector.

BACKGROUND OF THE INVENTION

1. Field of Invention

The present invention relates generally to containment and sealing of subterranean wells and more specifically to an apparatus and method for preparing a well casing and injecting an abrasive sealing mixture into a subterranean well on top of a mechanical plug barrier inside the tubulars.

2. Description of Related Art

In hydrocarbon production, when a hydrocarbon well has reached the end of its functional life, it is common to seal the wellbore with a series of plugs, as is commonly known, in preparation for abandonment. The purpose of the plugs is to create an impermeable barrier to prevent hydrocarbons or other fluids from migrating up the well and into the natural environment, such as into drinking water or to the surface.

In general, a minimum of three plugs are placed into a well to prepare for well abandonment. The most common material used to form the plugs is cement, which is pumped into the well as a slurry and allowed to harden in place. Additives may be used to enhance properties of the cement. Once set, the cement is durable and has a low permeability.

Typically, the cement slurry is pumped into the well through coil or jointed tubing from a rig on the surface. This method can result in the use of an excess volume of cement and there is a risk that the cement may cure prior to removal of the tubing, resulting in the tubing becoming stuck in the hole.

Another method to form the cement plug is with the use of a wireline deployed gravity displaced dump bailer. Disadvantageously, dump bailers may be activated with a ballistic or mechanical impact glass or ceramic bottom release system which can result in premature release of the cement if the bailer is dropped or bumped before reaching the desired plug location. Additionally, the cement may not be fully discharged from the bailer within the well, resulting in the possibility that the cement may harden within the bailer and limit its reuse. There is also a contamination problem caused by moving or shaking the bailer to have product release from the bailer.

Additionally, the above methods to seal a wellbore do not properly condition the casing for proper bonding of the cement or resin to the casing.

SUMMARY OF THE INVENTION

According to a first embodiment of the present invention there is disclosed an apparatus for preparing a casing of a subterranean well and injecting a sealing mixture into the subterranean well comprising an elongate body extending between top and bottom ends, the body connectable to a wireline at the top end thereof and having a plurality of nozzles extending through the body proximate to the bottom end thereof and a plurality of scrapers positioned within the body, each having a first position retracted within the body and a second position radially extended from the body engageable with the casing. The apparatus further comprises a cavity within the body operable to contain the sealing mixture therein and a piston slideably movable within the cavity so as to eject the sealing mixture through the plurality of nozzles.

The piston may divide the cavity into first and second chambers. The cavity may include a retention means selectably fluidically connected with the plurality of nozzles. The retention means may be selected from a group consisting of a check valve, a flap valve and a breakable seal.

The apparatus may further comprise a compressed gas tank within the body. The compressed gas tank may be fluidically connected to a valve assembly. The plurality of scrapers may include a plurality of radial pistons selectably fluidically connected to the compressed gas tank through the valve assembly. The plurality of radial pistons may be operable to extend the plurality of scrapers between the first position and the second position.

The compressed gas tank may be selectably fluidically connected through the valve assembly to the first chamber. The apparatus may further comprise at least one motor within the body, the at least one motor operable to selectably move the valve assembly. Each of the at least one motor may comprise a step motor. The apparatus may further comprise a control circuit connected to the wireline and to the at least one motor. The control system may comprise a processor.

The piston may include a bypass passage therethrough operable to selectively connect the first chamber with the second chamber.

According to a further embodiment of the present invention there is disclosed a method for preparing a casing of a subterranean well and sealing the subterranean well comprising positioning a body having a cavity therein in the subterranean well at a location to be sealed, extending a plurality of scraper assemblies from the body thereby engaging the plurality of scraper assemblies with the casing, displacing the body within the well so as to engage the plurality of scraper assemblies against a length of the casing and retracting the plurality of scraper assemblies. The method further comprises positioning the body in the subterranean well at the location to be sealed and slideably displacing a piston within the cavity of the body so as to eject a sealing mixture contained within the cavity through a plurality of nozzles fluidically connected to the cavity and located through the body.

The method may further comprise, prior to ejecting the sealing mixture, slideably displacing the piston within the cavity of the body so as to eject a cleaning fluid contained within the cavity through the plurality of nozzles, removing the body from the subterranean well and filling the cavity of the body with the sealing mixture and positioning the body in the subterranean well at the location to be sealed.

The piston may be displaced by introducing a compressed gas to the cavity on an opposite side of the piston from the plurality of nozzles. The compressed gas may be contained within a gas tank in the body with a valve assembly operable to selectably connect the gas tank with the scraper assemblies and with the cavity on the opposite side of the piston from the plurality of nozzles.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
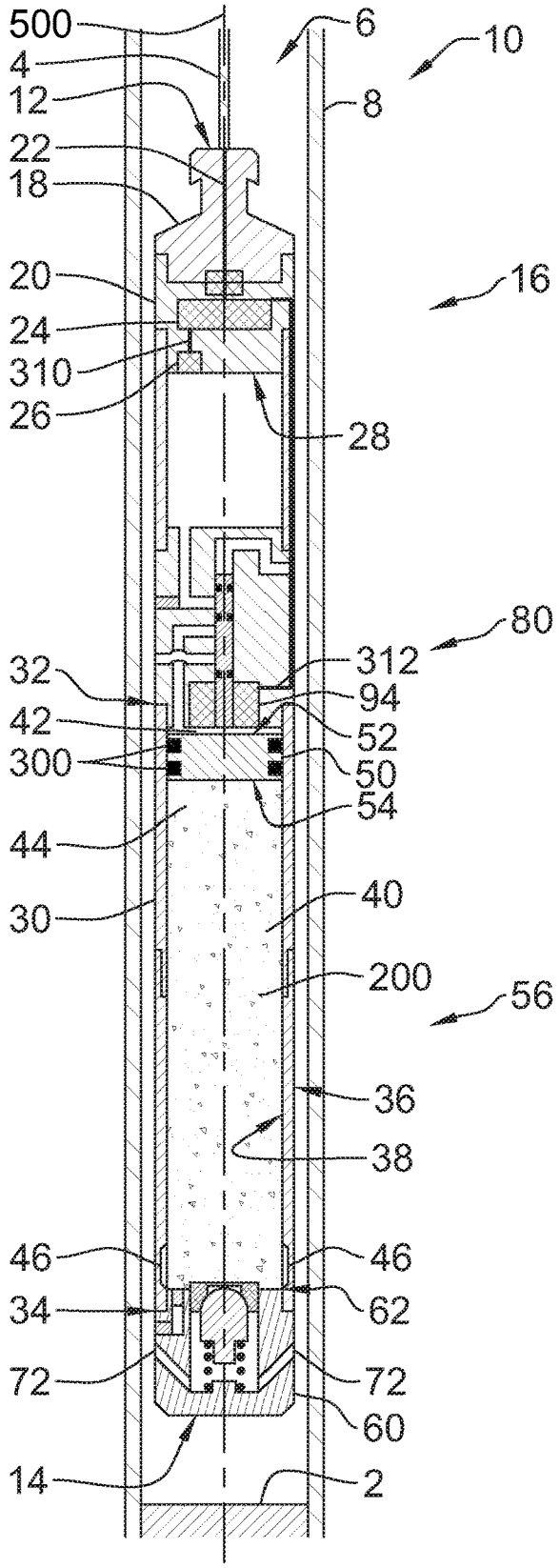
FIG. 1 is a cross-sectional schematic view of a sealing injector apparatus in a run-in position according to a first embodiment of the present direction.

Referring to FIG. 1, an apparatus for injecting an abrasive sealing mixture 200 into a subterranean well 6 having a casing 8 above a bridge plug 2 according to a first embodiment of the invention is shown generally at 10. The apparatus 10 comprises a substantially elongate cylindrical body extending between first and second ends, 12 and 14, respectively, along a central axis 500 and includes a control section 16 proximate to the first end 12 with a sealing injection section 56 proximate to the second end 14 and a piston activation section 80 therebetween. The sealing injection section 56 includes a cavity 40 adapted to retain the sealing mixture 200 therein. A piston 50 within the cavity 40 may be selectively moved to inject the sealing mixture 200 into the well 6 through a plurality of nozzles 72, as will be more fully described below.

The control section 16 includes a first end connector 18 proximate to the first end 12 and a control system housing 20, extending to a second end 28, attached thereto, by means as are commonly known. The first end connector 18 is attached to a wireline 4 at the first end 12 by means as are commonly known, such as threading or the like. The wireline 4 connects to an internal electric line 22 which passes through the first end connector 18 and provides electrical signals from the wireline 4 to a control system 24 within the control system housing 20. The control system 24 is comprised of such as, by way of non-limiting example, a solid-state board with control software and electrical connections 310 and 312 to a pressure transducer 26 and a step motor 94, respectively, the purpose of which will be set out below.

The sealing injection section 56 is comprised of a tubular piston housing 30 extending between first and second ends, 32 and 34, respectively, with an injection assembly housing 60 connected thereto at the second end 34. The injection assembly housing 60 extends between a first end 62 and the second end 14 and includes the nozzles 72 extending therethrough, as will be set out below.

The piston housing 30 includes outer and inner surfaces, 36 and 38, respectively, and forms the cavity 40 therein. The piston housing 30 includes a plurality of axial grooves 46 in the inner surface 38 proximate to the second end 34, the purpose of which will be set out below. The piston 50 is sealably retained in the piston housing 30 with piston seals 300 therebetween. The piston housing 30 may be comprised of two or more joined cylindrical portions, allowing for volume capacity adjustment of the cavity 40. The piston 50 includes first and second surfaces 52 and 54, respectively, and separates the cavity 40 into first and second cavities 42 and 44, respectively.

Figure 2:
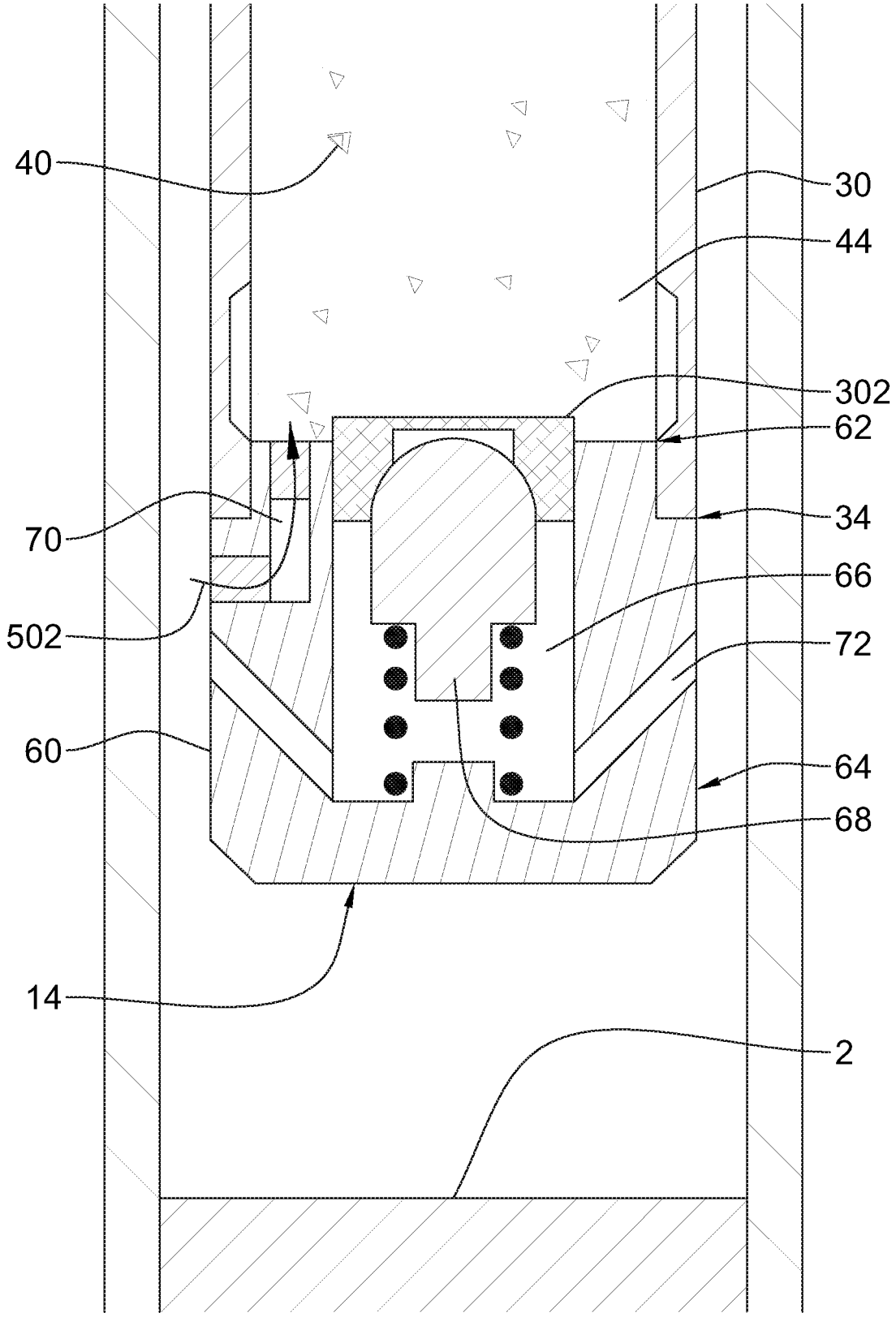
FIG. 2 is a detailed cross-sectional schematic view of the sealing injector apparatus of FIG. 1 at the second end in the run-in position.

Turning now to FIG. 2, the injection assembly housing 60, having an outer surface 64, is joined at the first end 62 to the second end 34 of the piston housing 30, as outlined above. The injection assembly housing 60 includes a central cavity 66 therein, fluidically connected to the nozzles 72. A cavity check valve 68 within the central cavity 66 is adapted to selectably fluidically connect the second cavity 44 with the nozzles 72. The cavity check valve 68 may include an optional filter 302 thereon. Although a check valve 68 is illustrated in the present embodiment of the invention, it will be appreciated that other selectable retention means may be used, as well, such as, by way of non-limiting example, a flap valve or breakable seal.

The injection assembly housing 60 includes a fill port passage 70 extending therethrough from the outer surface 64 to the first end 62, providing a fluidic connection from the outside of the apparatus 10 to the cavity 40. The fill port passage 70 includes an ORB fill port/check valve, as is commonly known, such that the sealing mixture 200 may pass in one direction only, generally indicated at 502, through the sealing fill port passage 70 into the cavity 40.

The plurality of nozzles 72 extend through the injection assembly housing 60 in an oblique radial direction between the central cavity 66 and the outer surface 64 such that the nozzles 72 are oriented in a direction generally towards the first end 62. The nozzles 72 may be oriented upwards at any angle. It will also be appreciated that angling the nozzles upwards may assist in lifting contaminants and debris off and away from the plug to provide a better seal thereover as well as to create a vacuum below the apparatus 10 thereby drawing the apparatus into closer contact with the bridge plug 2.

Figure 3:
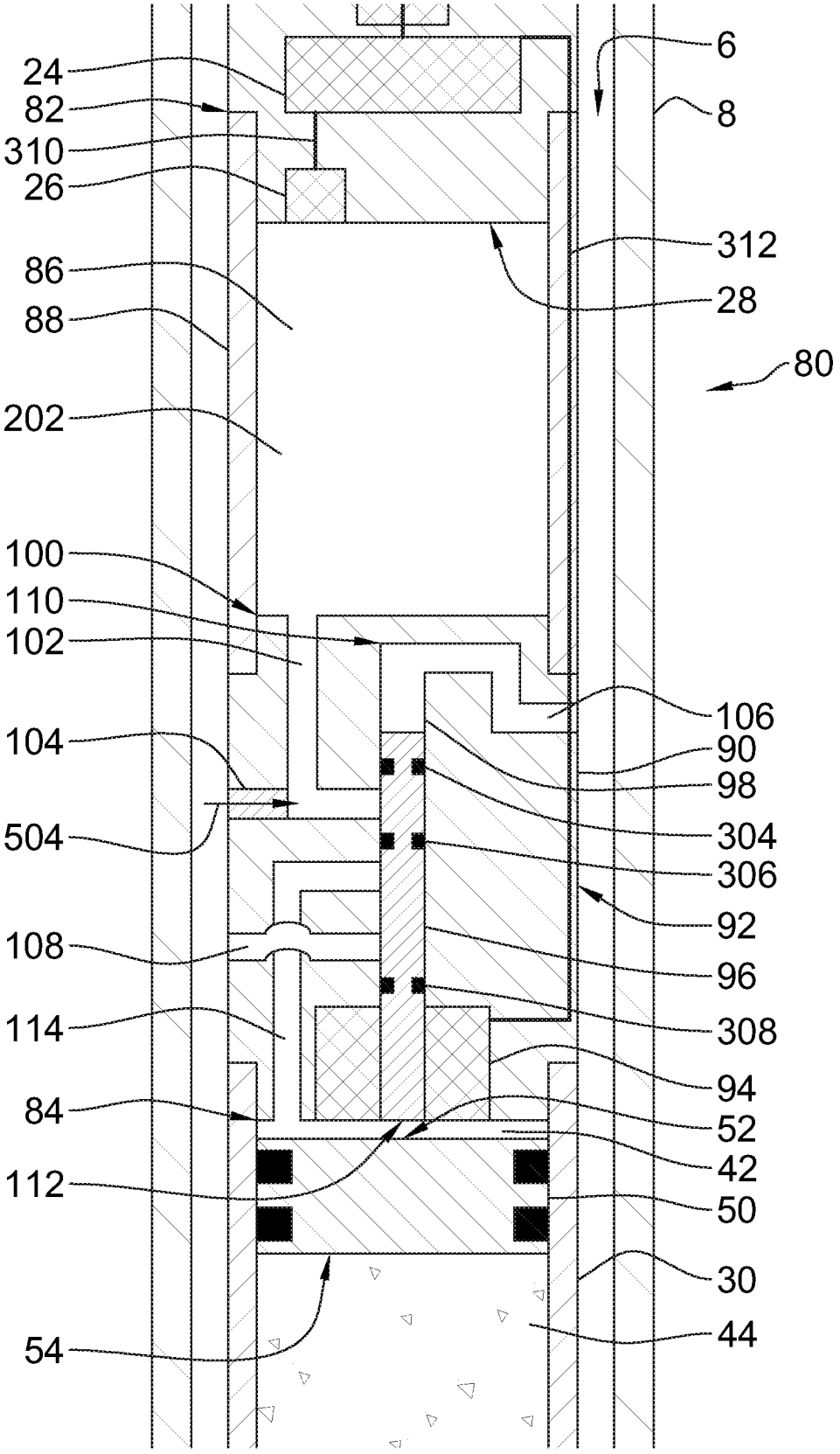
FIG. 3 is a detailed cross-sectional schematic view of the piston activation section in the run-in position.

Referring now to FIG. 3, the piston activation section 80 extends between first and second ends, 82 and 84, respectively, and includes a compressed gas chamber 86 within a cylindrical housing 88 extending from the first end 82, and a control valve assembly housing 90 extending between a first end 100 and the second end 84 and having an outer surface 92. The compressed gas chamber contains a compressed gas 202 such as, by way of non-limiting example, Nitrogen, although other compressed gases may be useful, as well. The pressure transducer 26 is positioned such that it is in fluidic communication with the compressed gas chamber 86 and thus provides a pressure measurement of the compressed gas 202 to the control system 24. The control valve assembly housing 90 includes the step motor 94 therein, joined by the electrical connection 312 to the control section 16, as outlined above.

The control valve assembly housing 90 includes a plurality of passages therethrough, selectively fluidically connecting the compressed gas chamber 86 with the first cavity 42, as will be described herein. A valve 96 is sealably retained within a valve passage 98 extending between first and second ends, 110 and 112, respectively, with first, second and third valve seals 304, 306 and 308, respectively, thereon. A compressed gas passage 102 extends through the control valve assembly housing 90 at the first end 100 and connects to the valve passage 98. In the run-in position, as illustrated in FIGS. 1 through 3, the valve 96 is positioned within the valve passage 98 such that the compressed gas passage 102 is sealed between the first and second valve seals, 304 and 306, thereby retaining the compressed gas 202 within the compressed gas chamber 86. A compressed gas fill port passage 104 extends through the outer surface 92 and fluidically connects to the compressed gas passage 102. The compressed gas fill port passage 104 includes an ORB fill port/check valve, as is commonly known, such that the compressed gas 202 may pass in one direction only, generally indicated at 504, through the compressed gas fill port passage 104 into the compressed gas chamber 86.

A piston path passage 114 extends through the control valve assembly housing 90 at the second end 84, fluidically connecting to the first cavity 42, and connects to the valve passage 98. In the run-in position, as illustrated in FIGS. 1 through 3, the valve 96 is positioned within the valve passage 98 such that the piston path passage 114 is sealed between the second and third valve seals, 306 and 308. First and second hydrostatic valve passages, 106 and 108, respectively, extend through the outer surface 92 and fluidically connect to the valve passage 98, allowing well fluid at a hydrostatic pressure therethrough and balancing the valve 96, as is commonly known. The first hydrostatic valve passage 106 fluidically connects to the valve passage 98 at the first end 110. The second hydrostatic valve passage 108 is positioned proximate to the third valve seal 308 and in the run-in position, as illustrated in FIGS. 1 through 3, the valve 96 is positioned within the valve passage 98 such that the second hydrostatic valve passage 108 is sealed between the second and third valve seals, 306 and 308. In this position, the piston path passage 114 and the second hydrostatic valve passage 108 are fluidically connected through the valve 96, thus maintaining the first cavity 42 at a hydrostatic pressure, equivalent to the pressure within the well 6.

Figure 4:
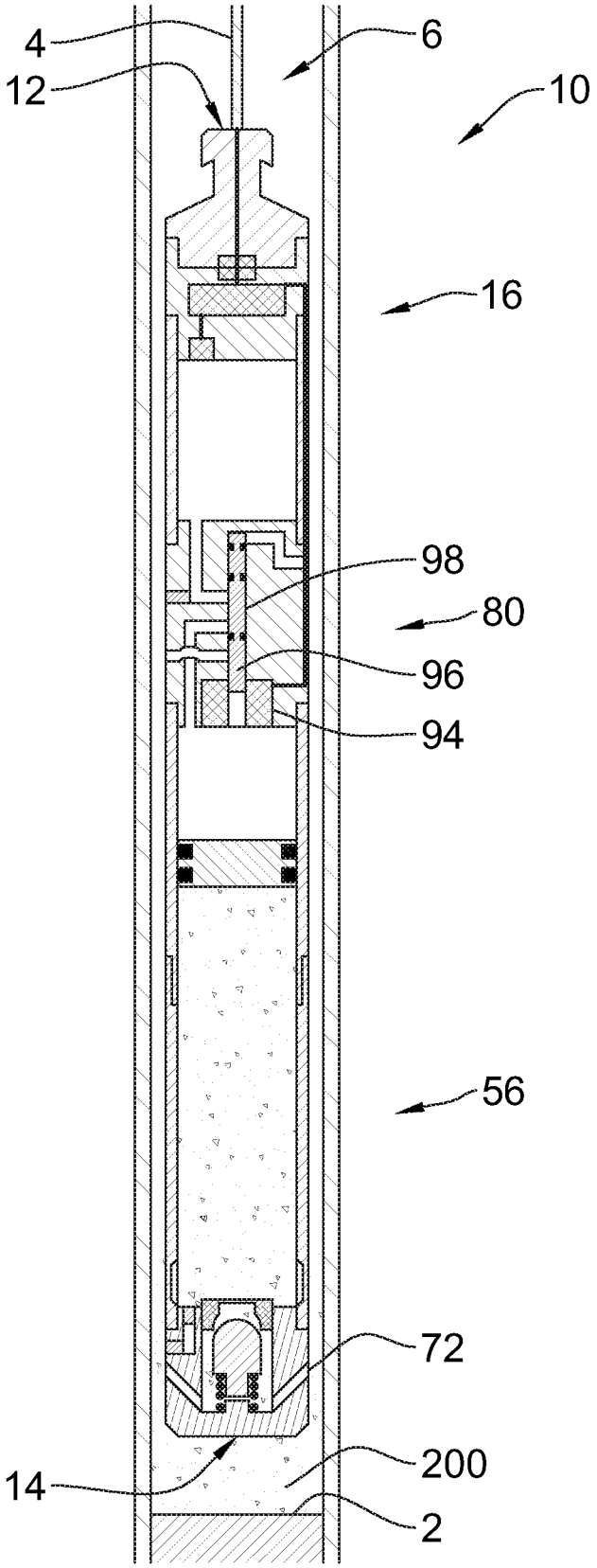
FIG. 4 is a cross-sectional schematic view of the sealing injector apparatus of FIG. 1 in an injecting position.
Figure 5:
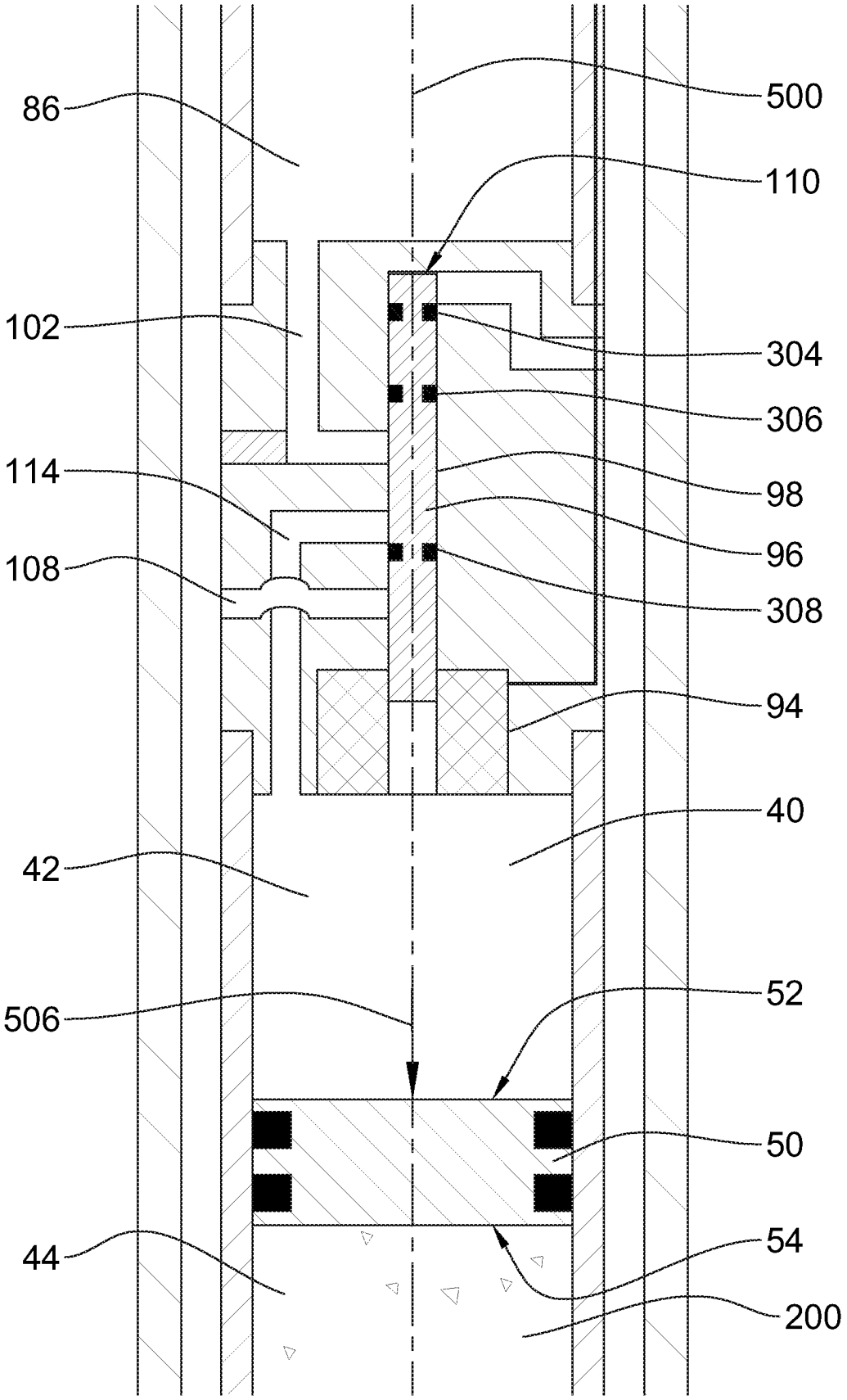
FIG. 5 is a detailed cross-sectional schematic view of the piston activation section in the injecting position.

Referring now to FIGS. 4 and 5, to inject the sealing mixture 200 into the well 6, the apparatus 10 is positioned within the well 6 at a desired location and a signal is sent through the wireline 4, as is commonly known. The control section 16 sends a signal to the step motor 94, activating the step motor 94 and shifting the valve 96 within the valve passage 98. As best seen on FIG. 5, the valve 96 is shifted axially along the central axis 500 towards the first end 110 of the valve passage 98, to the injecting position. In the injecting position, as illustrated in FIGS. 4 and 5, the valve 96 is positioned within the valve passage 98 such that the compressed gas passage 102 and the piston path passage 114 are sealed between the second and third valve seals, 306 and 308, with the second hydrostatic valve passage 108 sealed on an opposite side of the third valve seal 308. In this position, the compressed gas passage 102 and the piston path passage 114 are fluidically connected through the valve 96, thus fluidically connecting the compressed gas chamber 86 and the first cavity 42.

Figure 6:
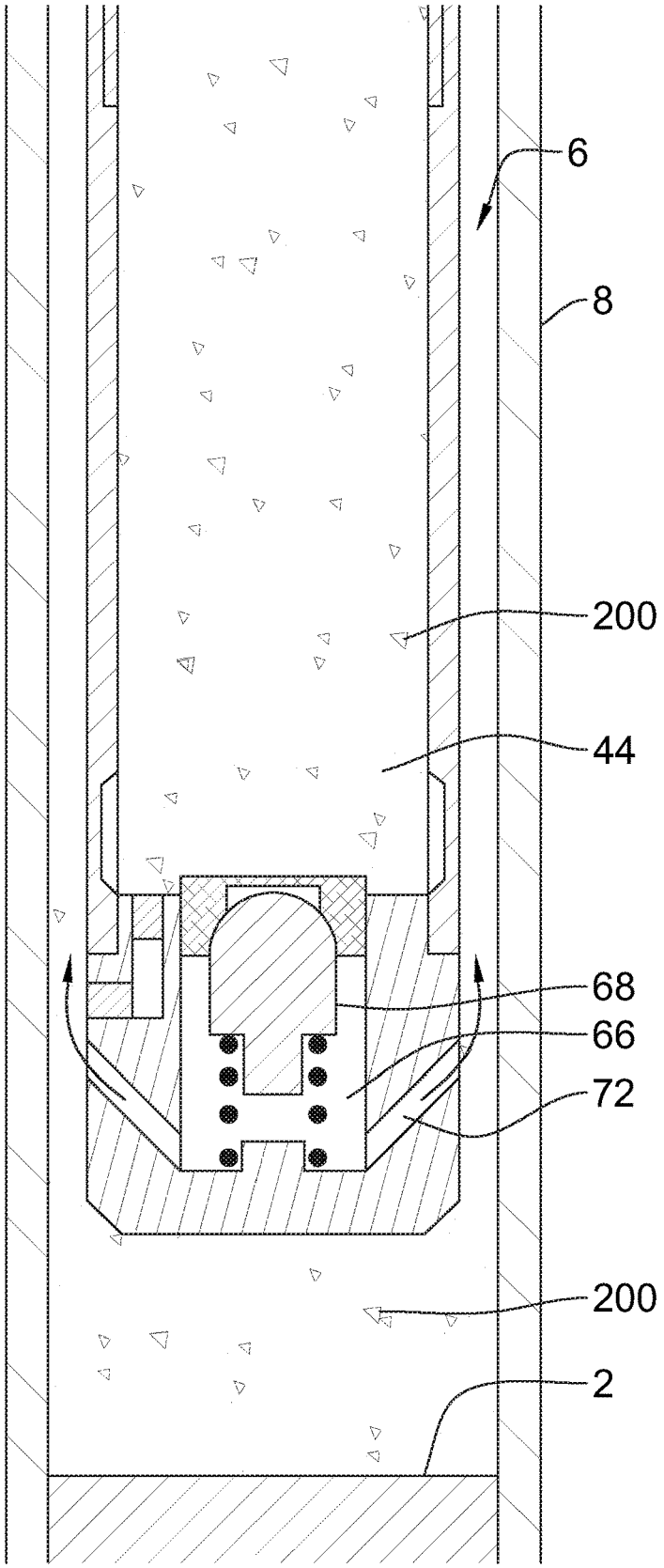
FIG. 6 is a detailed cross-sectional schematic view of the sealing injection section in the injecting position.

The pressure of the compressed gas 202 is pressurized to an activation pressure, such as, by way of non-limiting example, 10,000 PSI by way of non-limiting example, although it will be appreciated that other pressures may be useful as well when filled, whereas the pressure of the sealing mixture 200 within the second cavity 44 is essentially atmospheric. As the compressed gas 202 enters the first cavity 42 it applies a force to the first surface 52 of the piston 50 which in turn transfers the force to the sealing mixture 200 on the second surface 54 of the piston 50. As illustrated in FIG. 6, the force is sufficient to open the check valve 68, therefore fluidically connecting the second cavity 44 with the nozzles 72. The piston 50 moves in the direction generally indicated at 506 in FIG. 5, forcing the sealing mixture 200 through the check valve 68 into the central cavity 66 and out of the apparatus 10 through the nozzles 72. The abrasive sealing mixture 200 impacts the casing 8 at a high speed, clearing contaminants from the casing wall and promoting adhesion thereto.

The pressure of the compressed gas 202 is continuously measured by the pressure transducer 26, as outlined above. As the piston 50 moves towards the first end 62 of the injection assembly housing 60, the pressure within the compressed gas chamber 86 decreases, as is commonly known. Upon a decrease in pressure within the compressed gas chamber 86, the apparatus 10 is hoisted, therefore leaving the sealing mixture 200 over the bridge plug 2 to a depth required to form a permanent seal thereover such as, by way of non-limiting example, 3 meters for a resin-based, low-permeability gypsum cement or 8 meters for class "G" cement, although other interval distances for other sealants may be useful, as well. The sealing mixture 200 may be selected to be of any known or suitable sealing type such a cement and resin-based epoxies. Additionally, the sealing mixture 200 may include a quantity of inert particles therein such as, by way of non-limiting example, silicate or ceramic which will be appreciated may assist in removing contaminants and debris from the wellbore wall.

Figure 7:
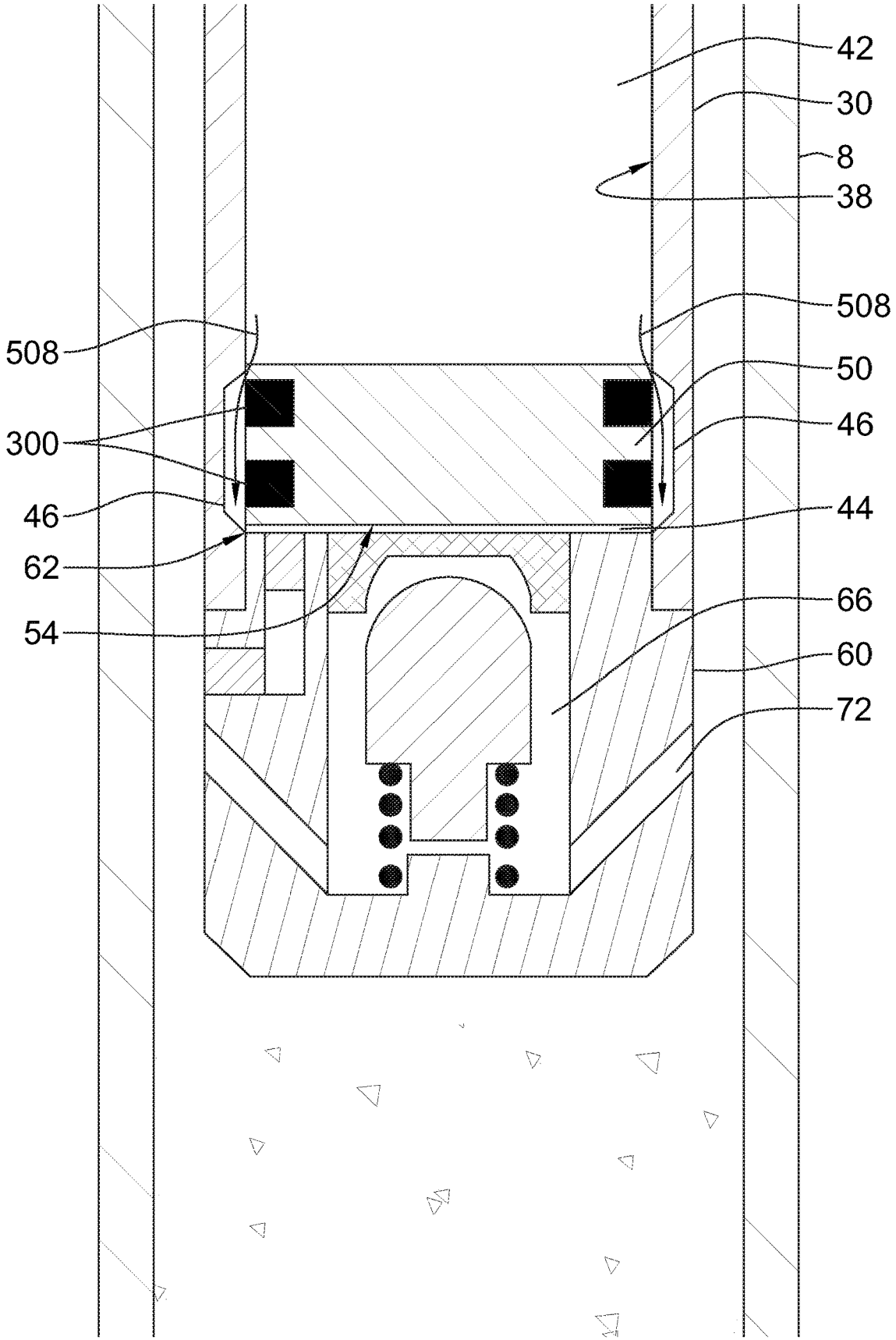
FIG. 7 is a detailed cross-sectional schematic view of the sealing injection section in the compressed gas bypass position.

The piston 50 continues to move within the piston housing 30 until the second surface 54 engages upon the first end 62 of the injection assembly housing 60, as illustrated in FIG. 7. In this position the piston 50 is aligned with the axial grooves 46 within the inner surface 38 of the piston housing 30. The piston seals 300 no longer sealably separate the first cavity 42 from the second cavity 44 and thus the compressed gas 202 passes around the piston 50 through the axial grooves 46 in the direction indicated at 508 into the second cavity 44. The compressed gas 202 thus passes into the central cavity 66 and out through the nozzles 72, eliminating the sealing mixture 200 therefrom.

The apparatus 10 is removed from the well 6 upon discharge of the compressed gas and may be returned to the run-in position and reloaded with the sealing mixture 200 and compressed gas 202 to seal the well 6 at another location, as desired.

Figure 8:
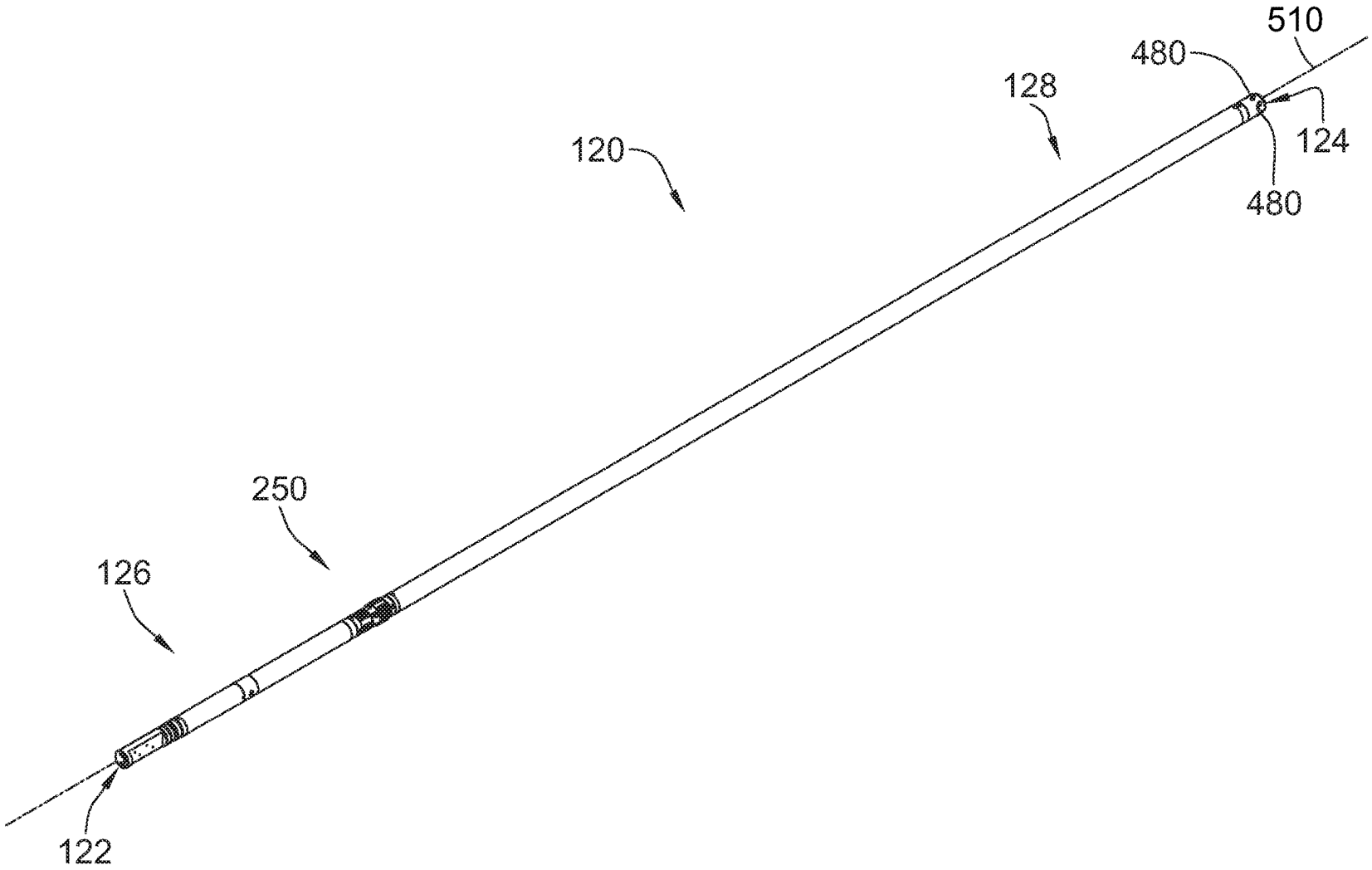
FIG. 8 is a perspective view of a sealing injector apparatus according to a further embodiment of the present invention.
Figure 9:
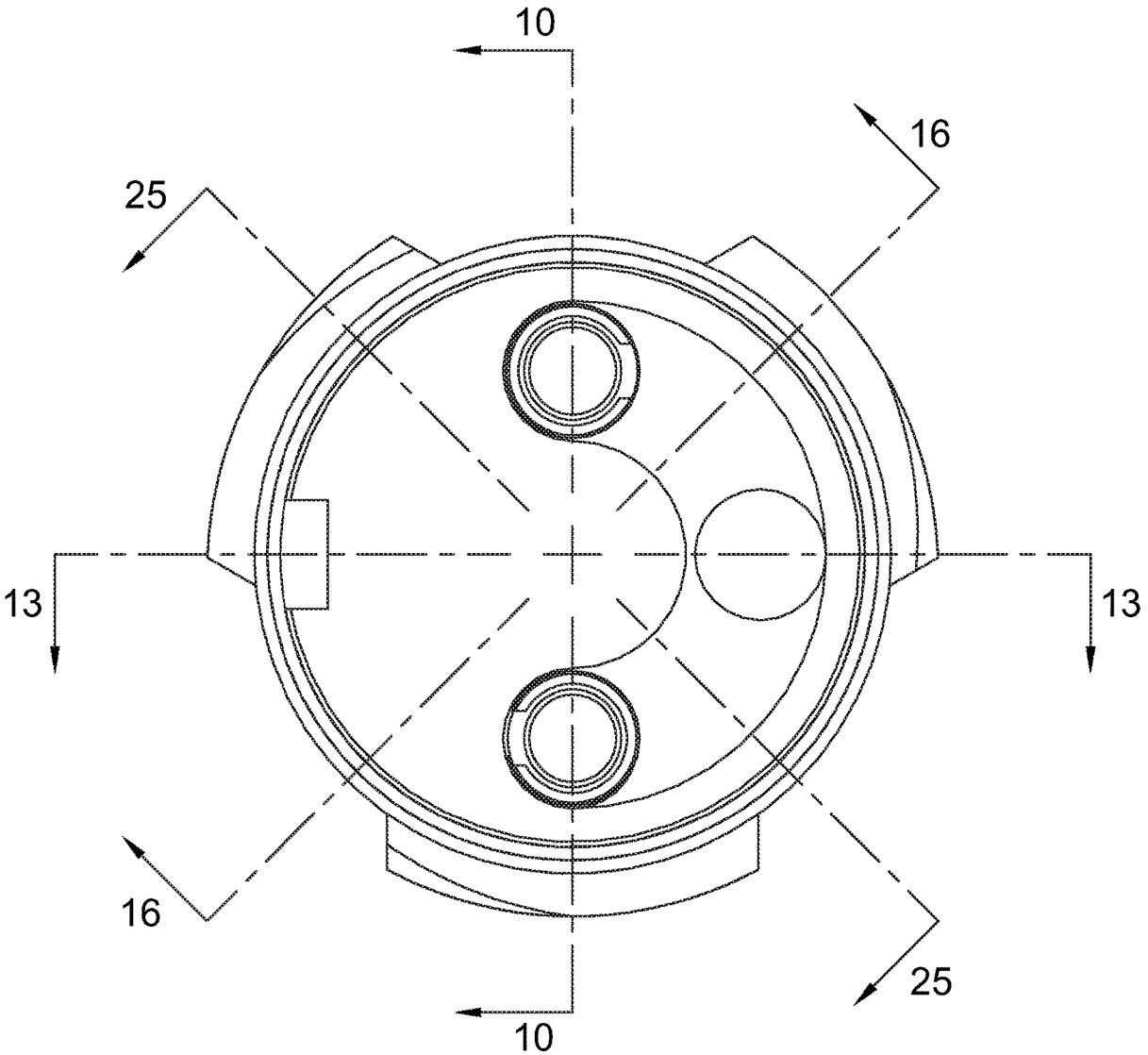
FIG. 9 is an end view of the apparatus of FIG. 8.
Figure 10:
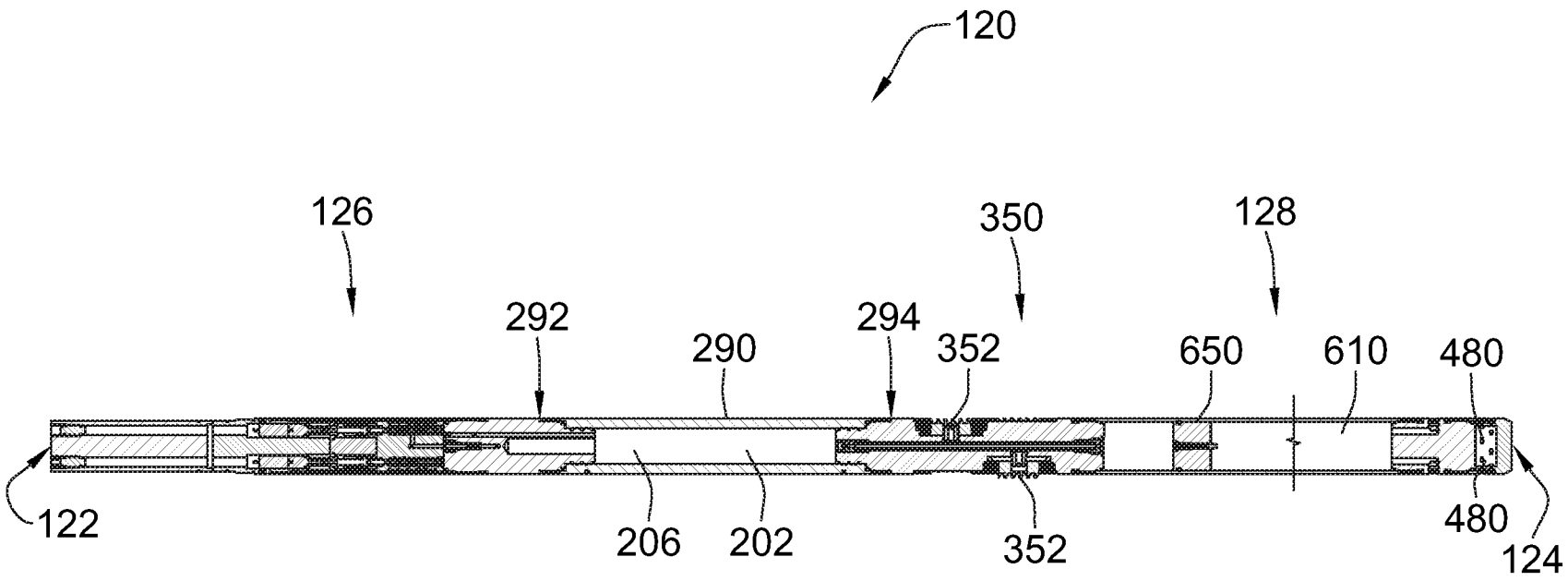
FIG. 10 is a side plane cross-sectional view of the apparatus of FIG. 8 taken along the line 10-10 of FIG. 9.

Turning now to FIGS. 8 and 10, an apparatus for injecting an abrasive sealing mixture 200 into a subterranean well 6 having a casing 8 above a bridge plug 2 according to a further embodiment of the invention is shown generally at 120. The apparatus 120 comprises a substantially elongate cylindrical body extending between first and second ends, 122 and 124, respectively, along a central axis 510 and includes a control and activation section 126 proximate to the first end 122 with an injection section 128 proximate to the second end 124 and a scraper section 350 therebetween. The scraper section 350 includes a plurality of extendable scrapers 352 operable to engage upon and mechanically scrape the casing 8 prior to injection, as will be set out further below. The injection section 128 includes a cavity 610 adapted to retain the sealing mixture 200 or a cleaning fluid 204 therein. As set out above, the sealing mixture 200 may include a quantity of particles therein to add abrasive properties and to aid in cleaning and bonding to the wellbore wall. It will be appreciated that the cleaning fluid 204 may also include a quantity of inert abrasive particles therein, such as, by way of non-limiting example, silicate or ceramic particles. A piston 650 within the cavity 610 may be selectively moved to inject the contents of the cavity 610, either the cleaning fluid 204 or the sealing mixture 200, into the well 6 through a plurality of nozzles 480, as will be more fully described below.

Figure 11:
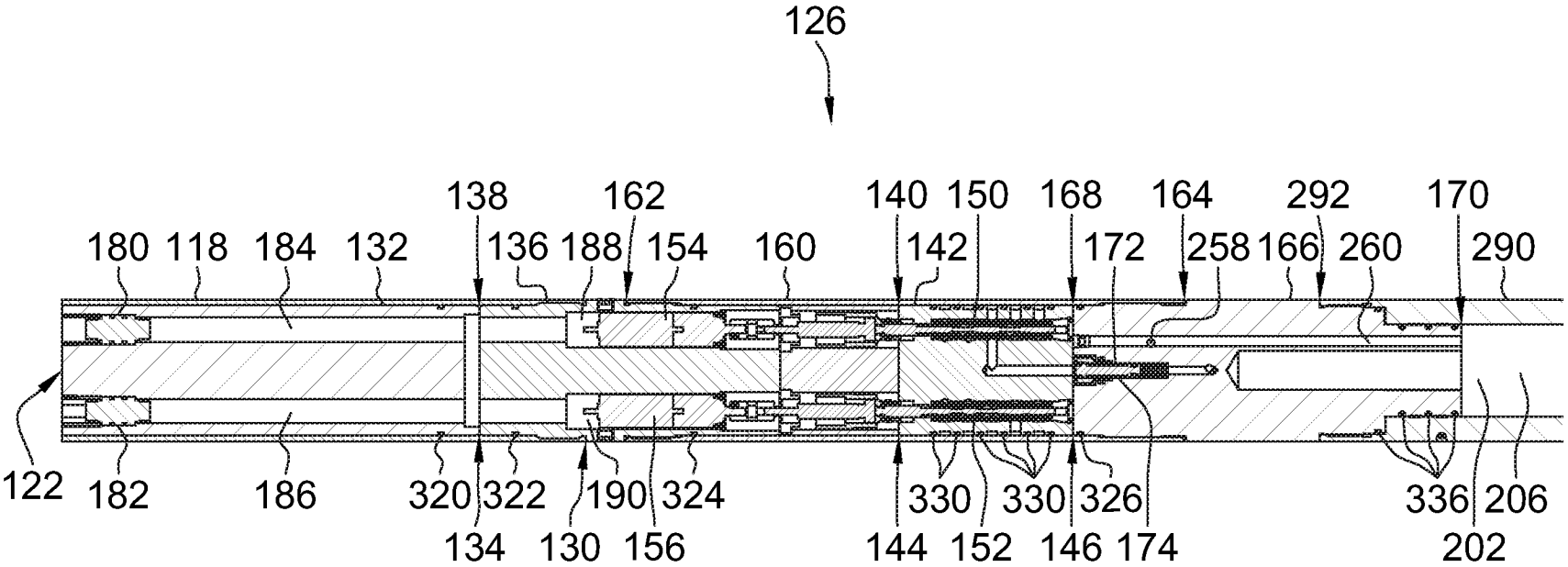
FIG. 11 is a detailed side plane cross-sectional view of the control and activation section of the apparatus of FIG. 8 taken along the line 10-10 of FIG. 9.

Referring to FIGS. 10 and 11, the control and activation section 126 utilizes signals from the wireline 4 to extend the scrapers 352 in the scraper section 350 and to control fluid flow through the nozzles 480 in the injection section 128 by controlling the positions of first and second valves, 150 and 152, respectively, with first and second electric motors, 154 and 156, respectively, such that compressed gas 202 contained in a compressed gas chamber 206 is selectively directed through a plurality of passages, as will be set out in further detail below.

Turning now to FIG. 11, the control and activation section 126 includes a first end connector 118 extending from the first end 122 to a second end 130. The first end connector 118 is attached to the wireline 4 at the first end 122 by means as are commonly known, such as threading or the like. A control system housing 132 is contained within the first end connector 118 and extends between the first end 122 and a second end 134 with a seal 320 therebetween proximate to the second end 134. The first and second electric motors, 154 and 156, are contained within a motor housing 136 which extends between first and second ends, 138 and 140, respectively, and is connected to the second end 134 of the control system housing 132 within the first end connector 118 at the first end 138 with a seal 322 therebetween. The first and second valves, 150 and 152, are contained within a valve manifold housing 142, which extends between first and second ends, 144 and 146, respectively. A valve outer housing 160 extends between first and second ends, 162 and 164, respectively. The valve outer housing 160 is secured to the motor housing 136 at the first end 162 with threading or the like and with a seal 324 therebetween. The valve manifold housing 142 is contained within the valve outer housing 160 with a plurality of valve manifold seals 326 therebetween. The second end 164 of the valve outer housing 160 is secured to a throttle valve housing 166 with a seal 326 therebetween. The throttle valve housing 166 extends between first and second ends, 168 and 170, respectively, and contains a 2-stage throttle valve 172 within a central throttle valve passage 174 therein, as will be set out below.

The wireline 4 provides electrical signals to a control system within the control system housing 132. The control system is comprised of such as, by way of non-limiting example, a solid-state board with control software and electrical connections through sealed first and second feedthrough electrical connectors 180 and 182, respectively, and through first and second valve electronics passages 184 and 186, respectively, to first and second electric motors, 154 and 156, respectively, connected by means as are commonly known. The first and second electric motors 154 and 156 are contained within first and second valve control cavities, 188 and 190, respectively, within the motor housing 136.

Figure 12:
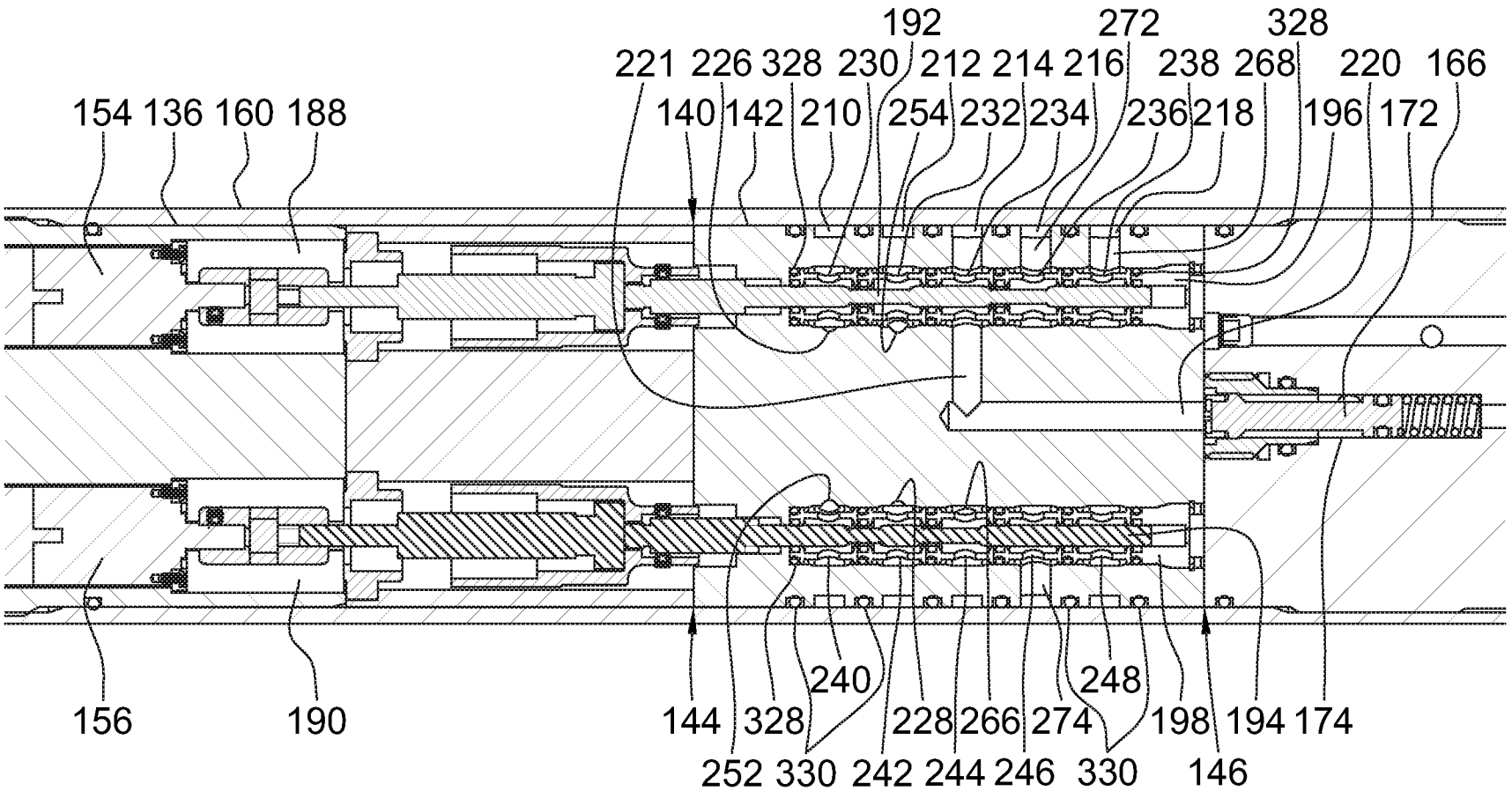
FIG. 12 is a detailed side plane cross-sectional view of the valve manifold of the apparatus of FIG. 8 taken along the line 10-10 of FIG. 9.

Turning now to FIG. 12, first and second valve manifold rods, 192 and 194, respectively, are contained within first and second valve cavities, 196 and 198, respectively, within the valve manifold housing 142. The valve manifold housing 142 is aligned such that the first end 144 engages upon the second end 146 of the motor housing 136 and the first and second valve cavities 196 and 198 are aligned with the first and second electric motors 154 and 156 within the first and second valve control cavities 188 and 190. The first and second electric motors 154 and 156 control the positions of the first and second valve manifold rods 192 and 194 with valve trains, as is commonly known.

The valve manifold housing 142 includes first, second, third, fourth and fifth annular passages, 210, 212, 214, 216 and 218, respectively, therearound proximate to the second end 146, and include the valve manifold seals 330 therebetween to sealably separate the annular valve passages. The first valve cavity 196 includes first, second, third, fourth and fifth first-valve ports 230, 232, 234, 236 and 238 respectively, and the second valve cavity 198 includes first, second, third, fourth and fifth second-valve ports 240, 242, 244, 248 and 248, respectively, with a plurality of seals 328 therebetween to sealably separate the valve ports, as is commonly known. A plurality of fluid passages are connected to the first and second valve cavities 196 and 198 at the valve ports, as will be set out further below. The first and second electric motors 154 and 156 control the positions of the first and second valve manifold rods 192 and 194 to adjust the fluidic connections between the plurality of fluid passages, as will be set out below and described more fully with schematics.

As illustrated in FIG. 12, a throttled compressed gas supply passage 220 is fluidically connected with the central throttle valve passage 174 within the throttle valve housing 166, as will be set out further below. The throttled compressed gas supply passage 220 is fluidically connected to the first valve manifold cavity 196 through the throttle compressed gas connection passage 221 and the third first-valve port 234.

Figure 13:
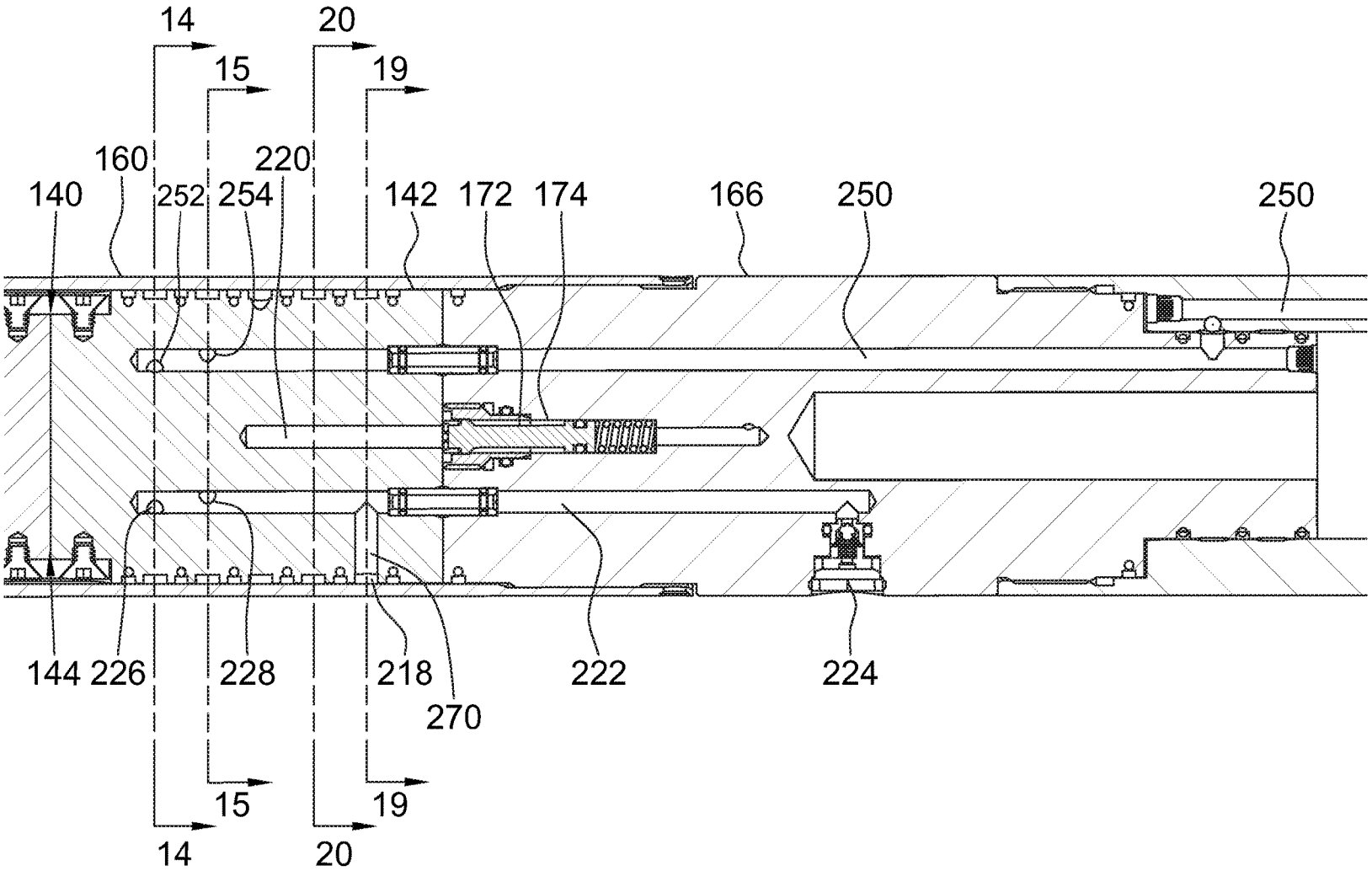
FIG. 13 is a detailed top plane cross-sectional view of the valve manifold of the apparatus of FIG. 8 taken along the line 13-13 of FIG. 9.
Figure 14:
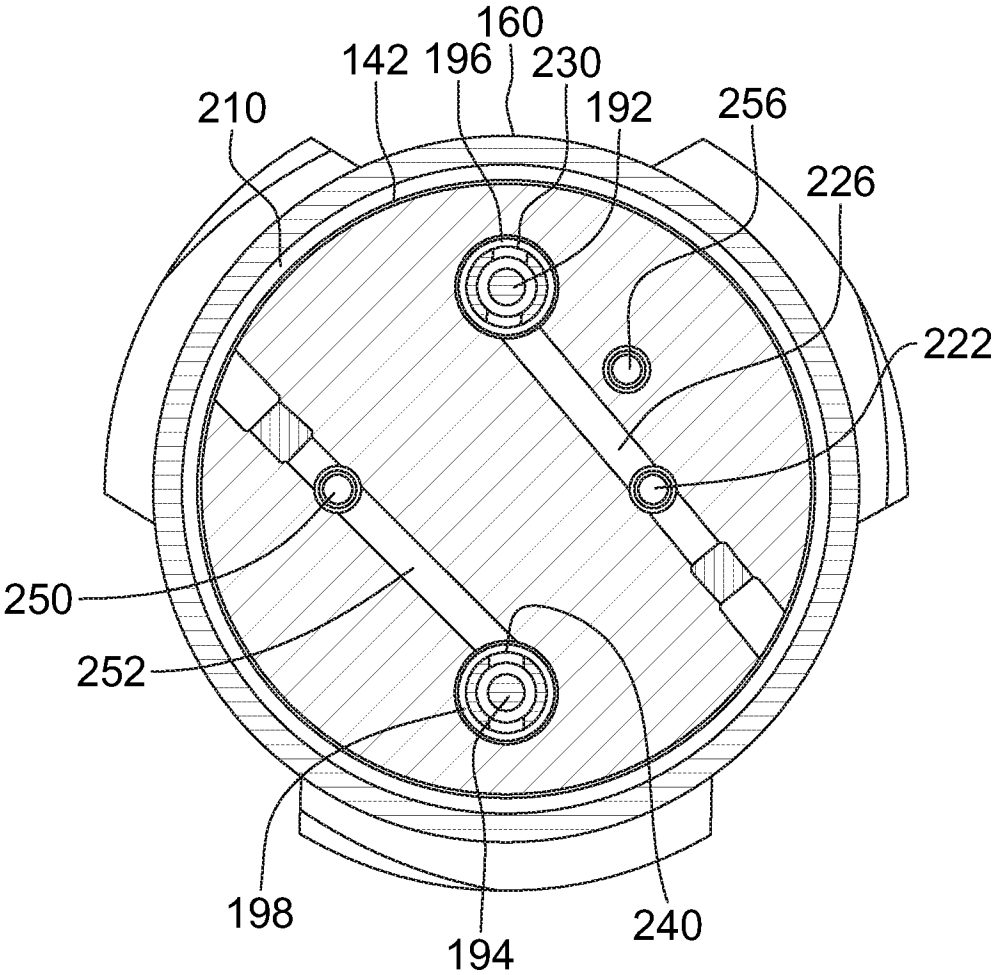
FIG. 14 is a radial cross-sectional view of the valve manifold of the apparatus of FIG. 8 taken along the line 14-14 of FIG. 13.
Figure 15:
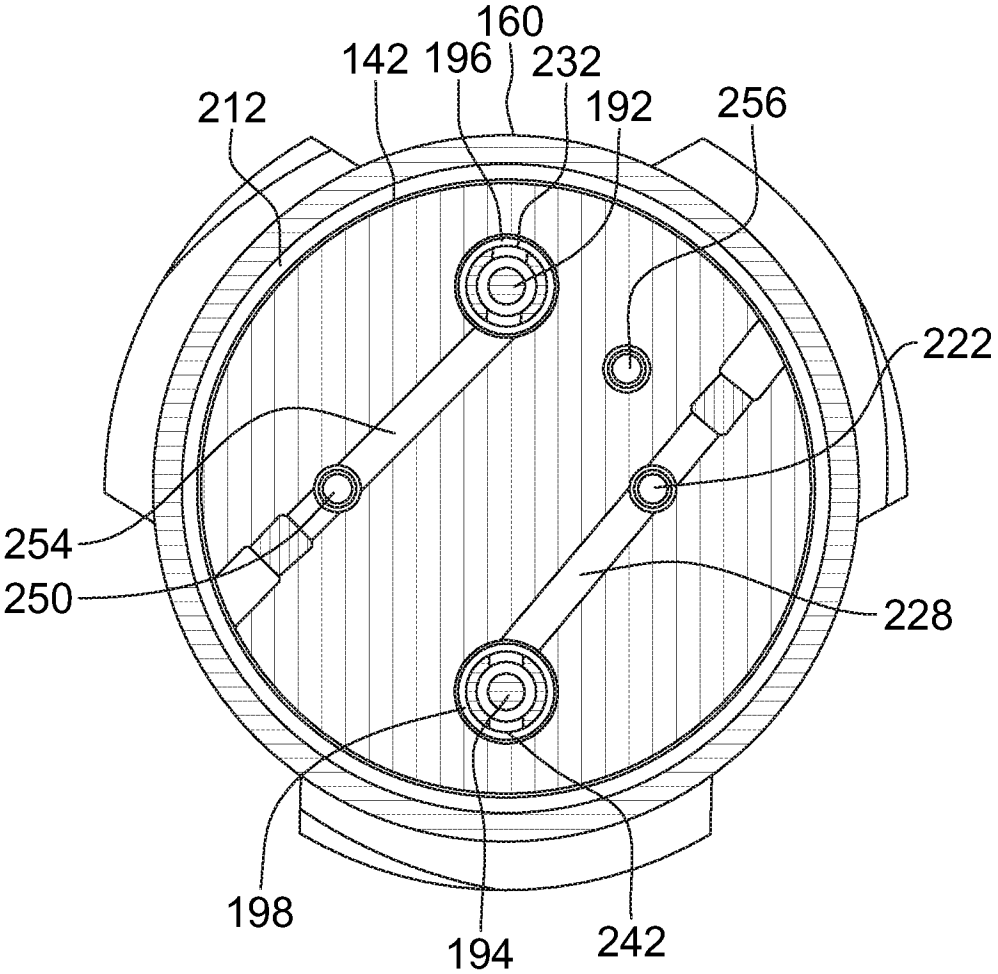
FIG. 15 is a radial cross-sectional view of the valve manifold of the apparatus of FIG. 8 taken along the line 15-15 of FIG. 13.
Figure 19:
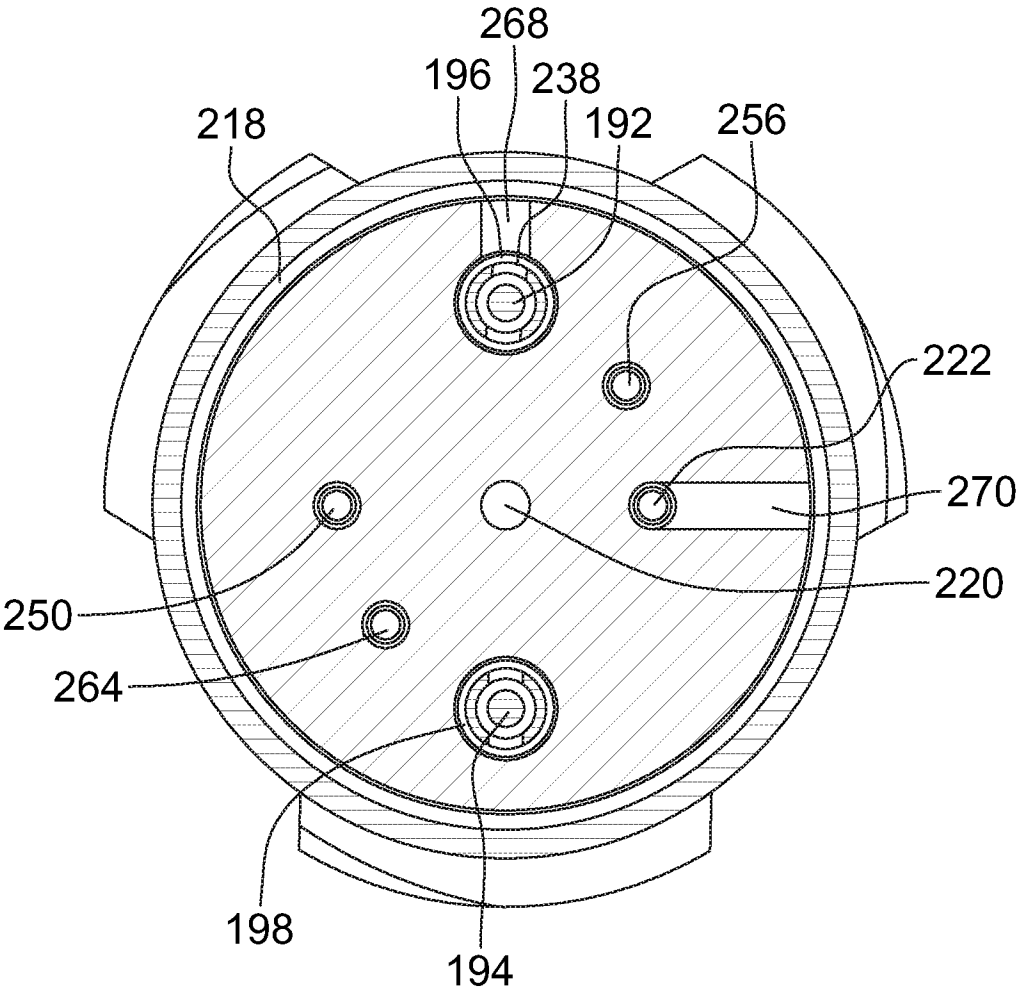
FIG. 19 is a radial cross-sectional view of the valve manifold of the apparatus of FIG. 8 taken along the line 19-19 of FIG. 13.

As illustrated in FIG. 12, the fifth annular passage 218 is fluidically connected to the first valve cavity 196 at the fifth first-valve port 238 through a connection passage 268. Turning now to FIG. 13, the fifth annular passage 218 is also fluidically connected to a bleed passage 222 through a connection passage 270. FIG. 19 further illustrates the connections at the fifth annular passage 218. Turning back to FIG. 13, the bleed passage 222 is fluidically connected to the hydrostatic fluid in the production casing 8 through a check valve 224, allowing for the contents of the bleed passage 222 to pass out of the apparatus 120 and into the surrounding hydrostatic fluid. The bleed passage 222 is also fluidically connected to first and second bleed connection passages, 226 and 228. As illustrated in FIGS. 12, 13 and 14, the first bleed connection passage 226 is fluidically connected to the first valve manifold cavity 196 at the first first-valve port 230. As illustrated in FIGS. 12, 13 and 15, the second bleed connection passage 228 is fluidically connected to the second valve manifold cavity 198 at the second second-valve port 242.

As illustrated in FIG. 13, an injection supply passage 250 extends from the valve manifold housing 142 and through the throttle valve housing 166, as will be set out further below. The injection supply passage is fluidically connected to first and second injection connection passages, 252 and 254, respectively, within the valve manifold housing 142. As illustrated in FIGS. 12, 13 and 14, the first injection connection passage 252 is fluidically connected to the second valve manifold cavity 198 at the first second-valve port 240. As illustrated in FIGS. 12, 13 and 15, the second injection connection passage 254 is fluidically connected to the first valve manifold cavity 196 at the second first-valve port 232.

Figure 16:
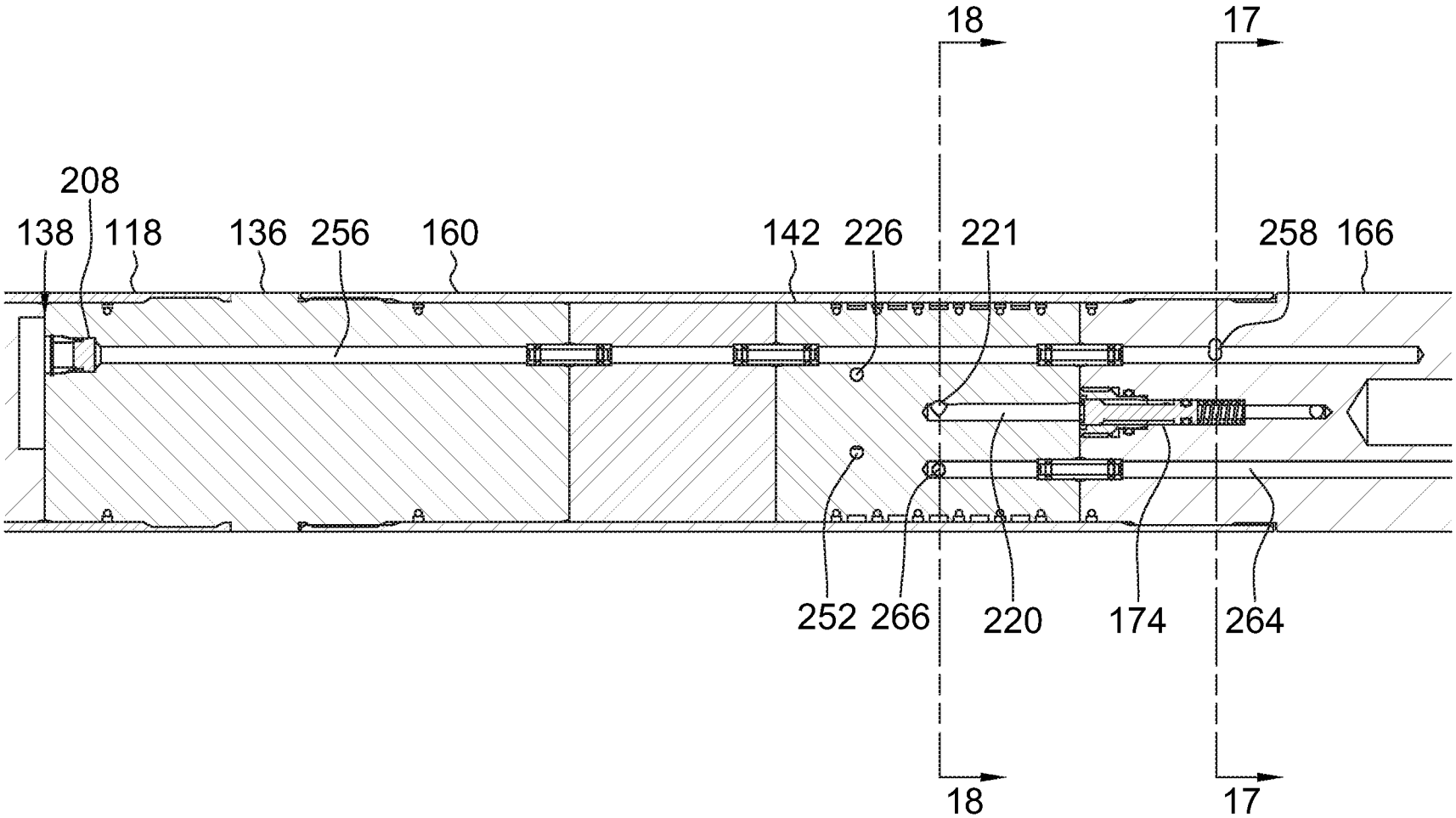
FIG. 16 is a detailed angled plane cross-sectional view of the motor housing and valve manifold of the apparatus of FIG. 8 taken along the line 16-16 of FIG. 9.
Figure 17:
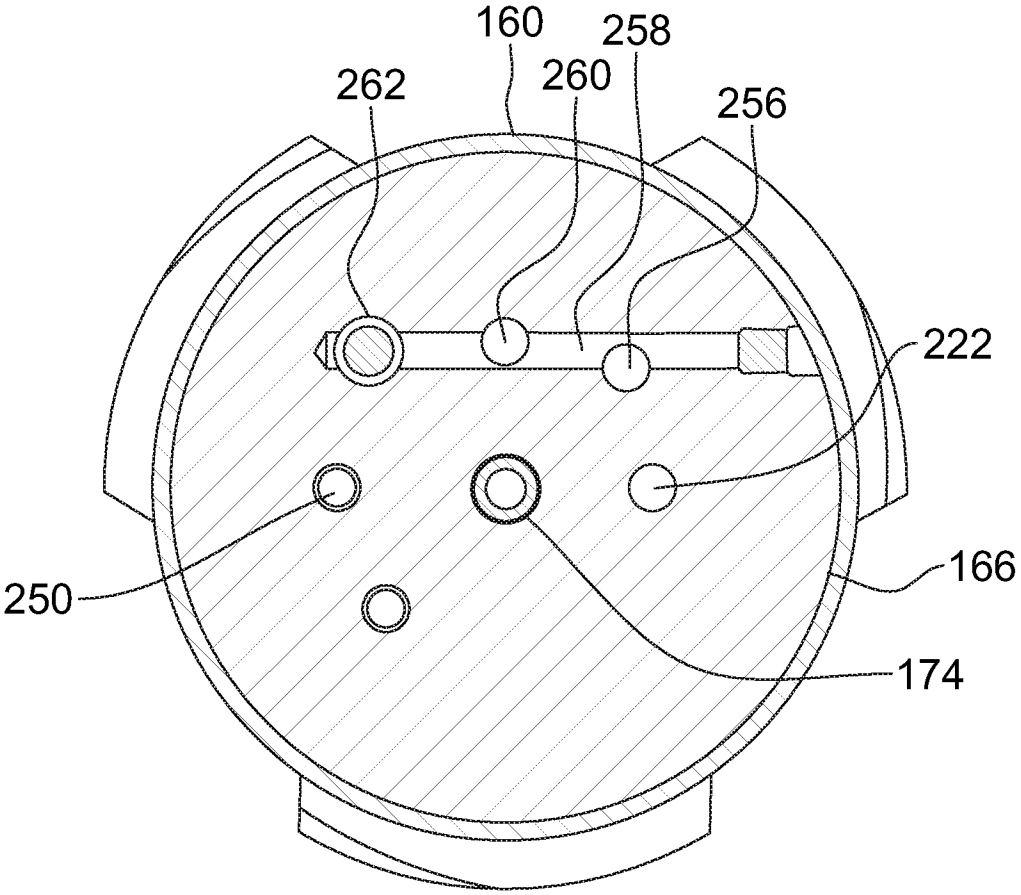
FIG. 17 is a radial cross-sectional view of the throttle valve housing of the apparatus of FIG. 8 taken along the line 17-17 of FIG. 16.

Turning now to FIG. 16, a first compressed gas passage 256 extends from the first end 138 of the motor housing 136, through the valve manifold housing 142 and into the throttle valve housing 166. The first compressed gas passage 256 includes pressure transducer 208, as is commonly known, proximate to the first end 138 of the motor housing 136. As illustrated in FIGS. 16 and 17, a compressed gas connection passage 258 extends from the first compressed gas passage 256 within the throttle valve housing 166 and joins a second compressed gas passage 260 which is fluidically connected to the compressed gas chamber 206 within a compressed gas housing 290, as illustrated in FIG. 11. Referring to FIG. 17, the compressed gas connection passage 258 is also fluidically connected to a first stage throttle valve chamber 262, thus providing full pressure compressed gas 202 to the first stage throttle valve chamber 262, as will be set out further below.

Figure 18:
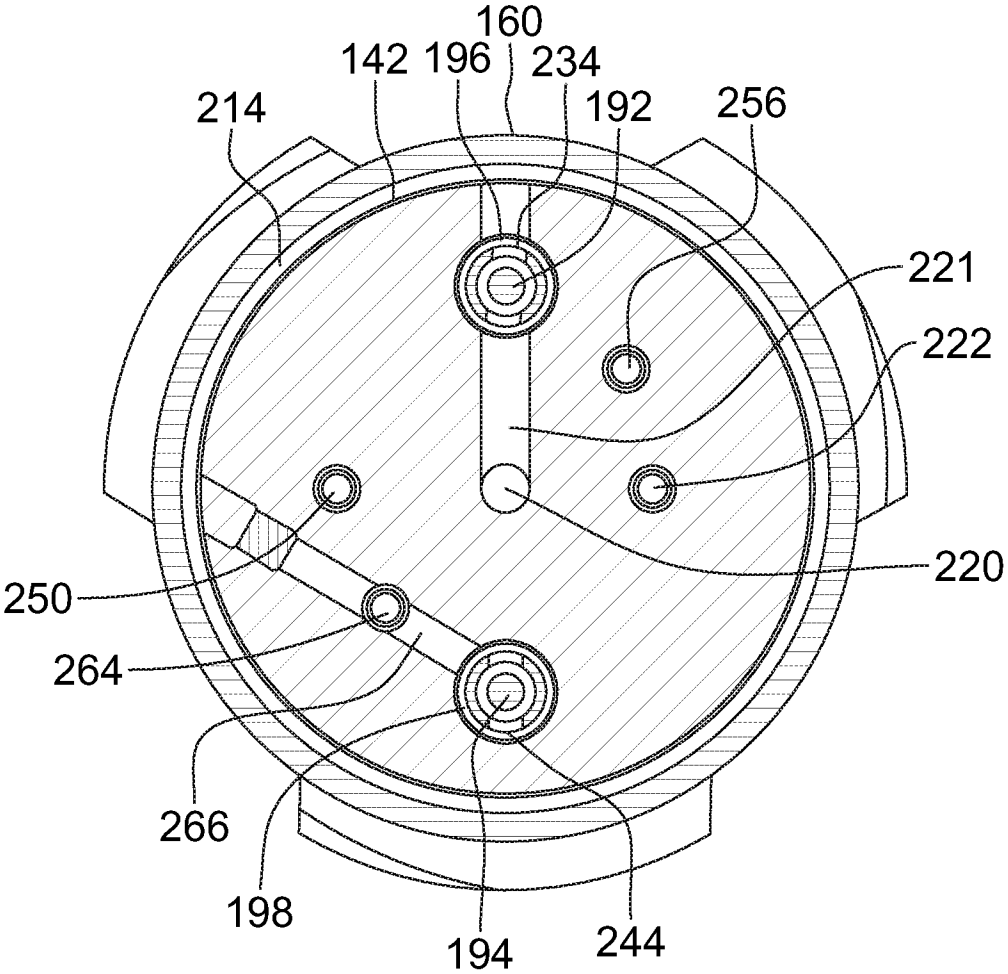
FIG. 18 is a radial cross-sectional view of the valve manifold of the apparatus of FIG. 8 taken along the line 18-18 of FIG. 16.

As illustrated on FIG. 16, a scraper supply passage 264 extends from the valve manifold housing 142 and through the throttle valve housing 166, as will be set out further below. The scraper supply passage 264 is fluidically connected to the scraper supply connection passage 266. As illustrated in FIGS. 12, 16 and 18, the scraper supply connection passage 266 is fluidically connected to the second valve manifold cavity 198 at the third second-valve port 244.

Figure 20:
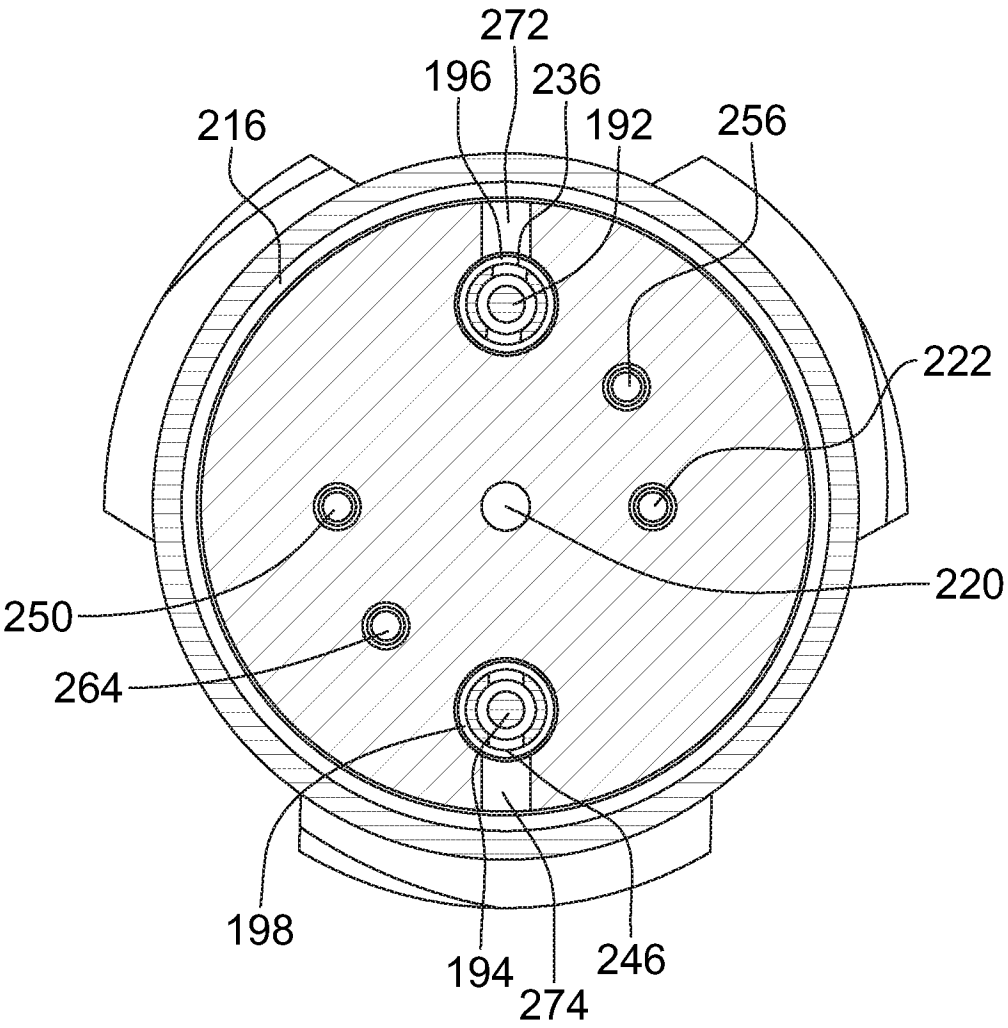
FIG. 20 is a radial cross-sectional view of the valve manifold of the apparatus of FIG. 8 taken along the line 20-20 of FIG. 13.

Referring now to FIGS. 12 and 20, the fourth annular passage 216 fluidically connects the first valve manifold cavity 196 at the fourth first-valve port 236 to the second valve manifold cavity 198 at the fourth second-valve port 246 with connection passages 272 and 274.

FIGS. 21 through 24 schematically illustrate the first and second valves 150 and 152 and the plurality of fluid passages as set out above in a first through a fourth operating position.

Figure 21:
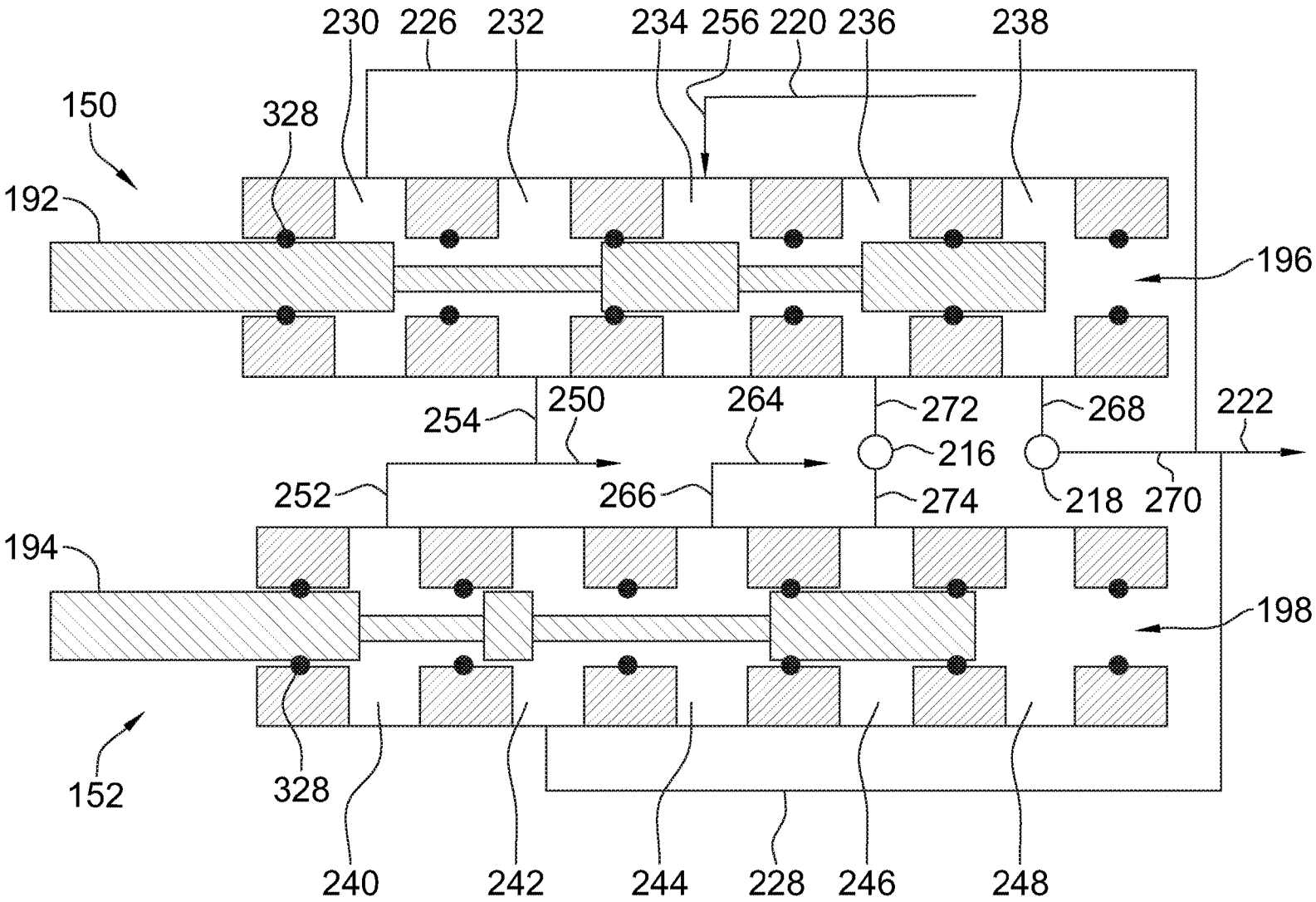
FIG. 21 is a schematic diagram of the valve manifold of the apparatus of FIG. 8 in a first position.

As illustrated in FIG. 21, compressed gas 202 from the throttled compressed gas supply passage 220 enters the first valve 150 through the first compressed gas passage 256 into the third first-valve port 234. In the first operating position, as illustrated, the position of the first valve manifold rod 192 is set for a fluidic connection between the third first-valve port 234 and the fourth first-valve port 236. The fourth first-valve port 236 is connected to the fourth second-valve port 246, which is sealed by the second valve manifold rod 194 in the first operating position. Thus, the compressed gas is blocked in the first operating position, and is retained within the compressed gas chamber 206.

Still referring to FIG. 21, the scraper supply passage 264 is fluidically connected to the third second-valve port 244 of the second valve 152 through the scraper supply connection passage 266. In the first operating position, as illustrated, the position of the second valve manifold rod 194 is set for a fluidic connection between the first, second and third second-valve ports, 240, 242 and 244, respectively. The second second-valve port 242 is connected to the bleed passage 222, therefore the scraper supply passage 264 is fluidically connected to the bleed passage, thus maintaining the scraper supply passage 264 at hydrostatic pressure in the first operating position.

The injection supply passage 250 is fluidically connected to the first second-valve port 240 of the second valve 152 through the first injection connection passage 252 and to the second first-valve port 232 through the second injection connection passage 254. In the first operating position, as illustrated, the position of the second valve manifold rod 194 is set for a fluidic connection between the first, second and third second-valve ports, 240, 242 and 244, respectively. The position of the first valve manifold rod 192 is set for a fluidic connection between the first and second first-valve ports, 230 and 232, respectively. The second second-valve port 242 is connected to the bleed passage 222, and the first first-valve port 230 is also connected to the bleed passage 222, therefore the injection supply passage 250 is fluidically connected to the bleed passage, thus maintaining the injection supply passage 250 at hydrostatic pressure in the first operating position.

Figure 22:
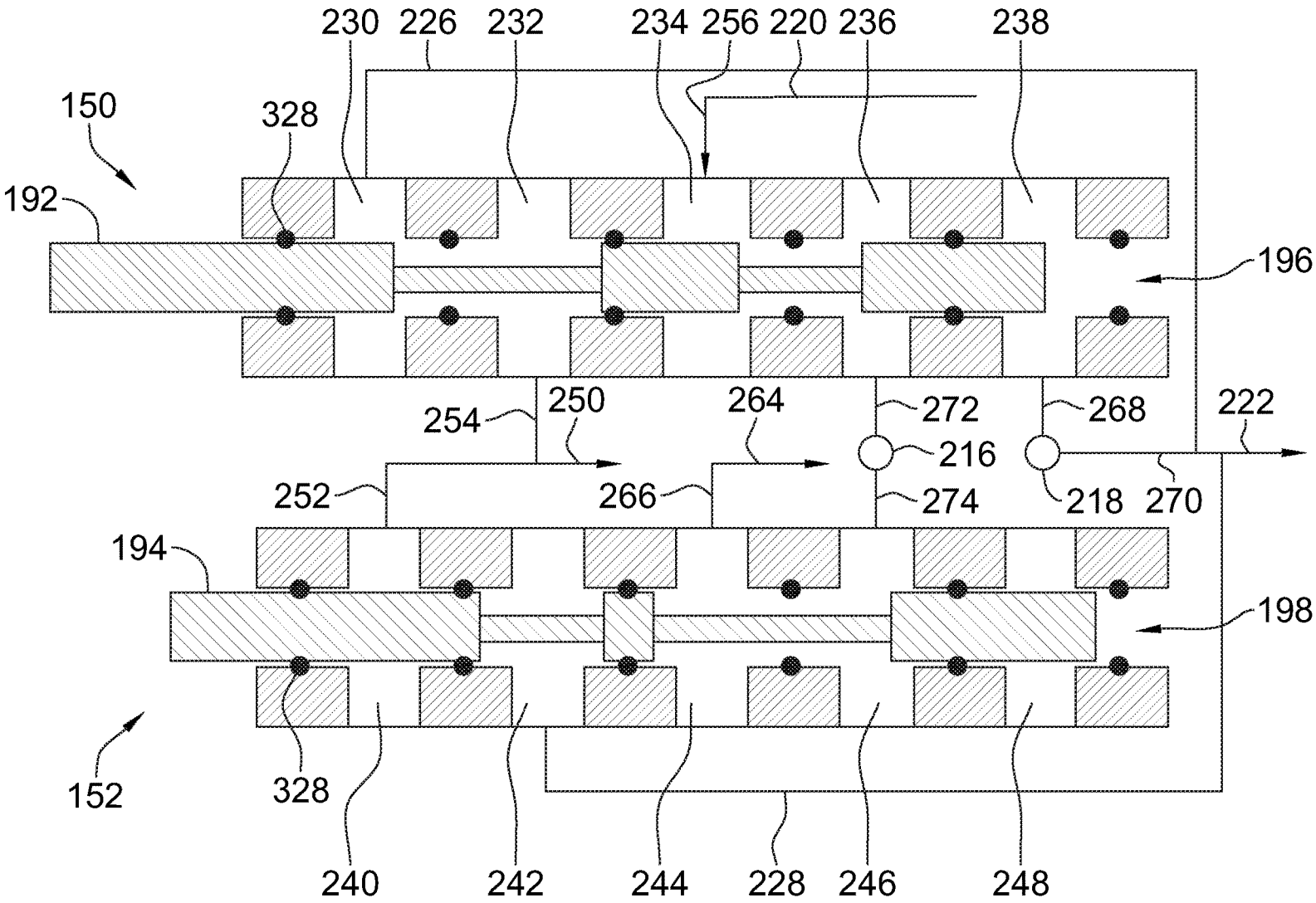
FIG. 22 is a schematic diagram of the valve manifold of the apparatus of FIG. 8 in a second position.

Turning now to FIG. 22, compressed gas 202 from the throttled compressed gas supply passage 220 enters the first valve 150 through the first compressed gas passage 256 into the third first-valve port 234. In the second operating position, as illustrated, the position of the first valve manifold rod 192 is set for a fluidic connection between the third first-valve port 234 and the fourth first-valve port 236. The fourth first-valve port 236 is connected to the fourth second-valve port 246. The position of the second valve manifold rod 194 is set such that the fourth second-valve port 246 is connected to the third second-valve port 244. The third second-valve port 244 is fluidically connected to the scraper supply passage 264 through the scraper supply connection passage 266. Thus, in the second operating position, the compressed gas is directed to the scraper supply passage 264.

Still referring to FIG. 22, the injection supply passage 250 is fluidically connected to the first second-valve port 240 of the second valve 152 through the first injection connection passage 252 and to the second first-valve port 232 through the second injection connection passage 254. In the second operating position, as illustrated, the position of the second valve manifold rod 194 is set such that the first second-valve ports 240 is sealed. The position of the first valve manifold rod 192 is set for a fluidic connection between the first and second first-valve ports, 230 and 232, respectively. The first first-valve port 230 is connected to the bleed passage 222, therefore the injection supply passage 250 is fluidically connected to the bleed passage 222, thus maintaining the injection supply passage 250 at hydrostatic pressure in the second operating position.

Figure 23:
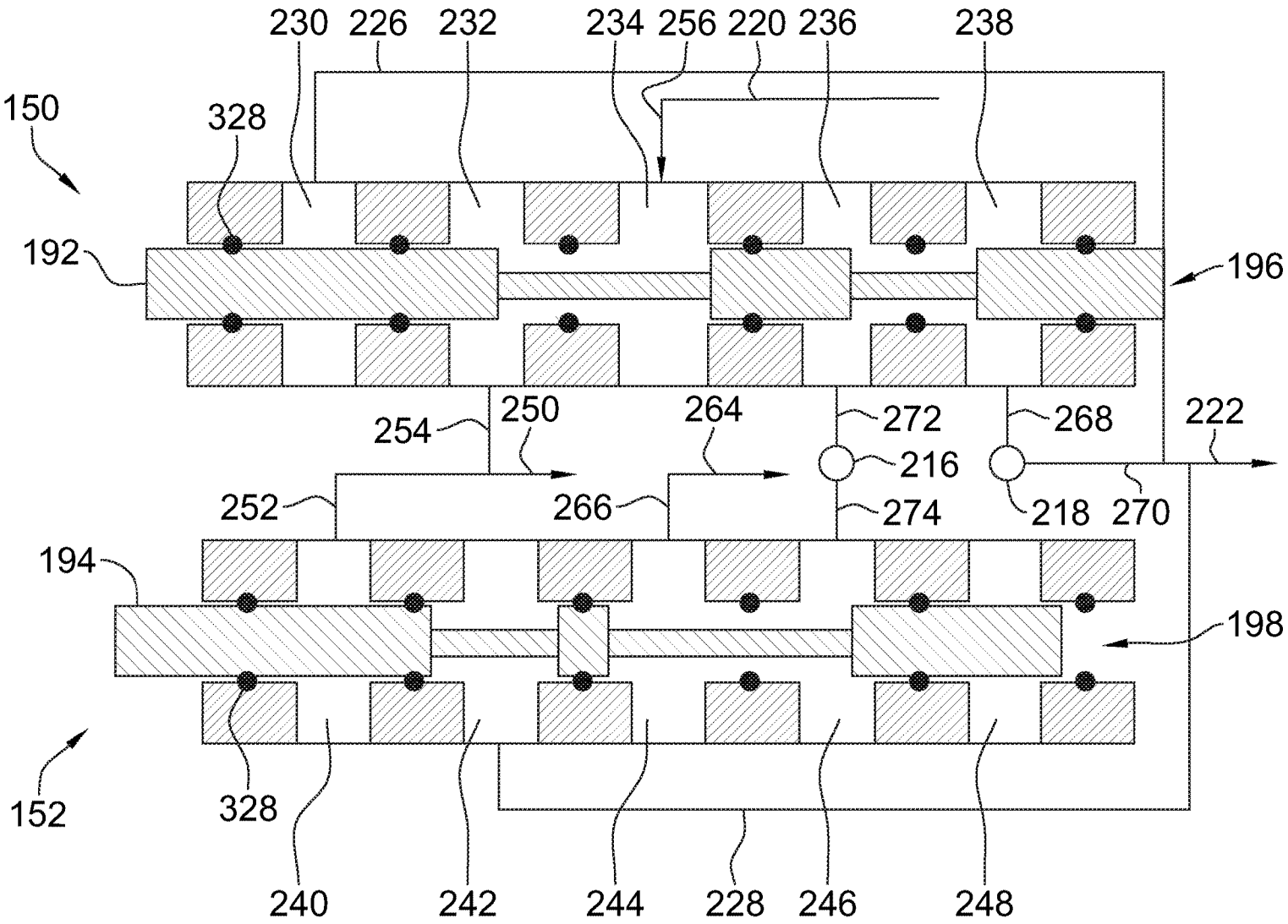
FIG. 23 is a schematic diagram of the valve manifold of the apparatus of FIG. 8 in a third position.

Turning now to FIG. 23, compressed gas 202 from the throttled compressed gas supply passage 220 enters the first valve 150 through the first compressed gas passage 256 into the third first-valve port 234, as set out above. In the third operating position, as illustrated, the position of the first valve manifold rod 192 is set for a fluidic connection between the third first-valve port 234 and the second first-valve port 232. The second first-valve port 232 is connected to the injection supply passage 250 through the second injection connection passage 254. The second first-valve port 232 is also connected to the first second-valve port 240, which is sealed by the second valve manifold rod 194. Thus, the compressed gas is directed to the injection supply passage 250 in the third operating position.

Still referring to FIG. 23, the scraper supply passage 264 is fluidically connected to the third second-valve port 244 of the second valve 152 through the scraper supply connection passage 266. In the third operating position, as illustrated, the position of the second valve manifold rod 194 is set for a fluidic connection between the third and fourth second-valve ports, 244 and 246, respectively. The fourth second-valve port 246 is connected to fourth first-valve port 236. The position of the first valve manifold rod 192 is set for fluidic connection between the fourth first-valve port 236 and the fifth first-valve port 238. The fifth first-valve port 238 is fluidically connected to the bleed passage 222. Therefore, in the third operating position, the scraper supply passage 264 is fluidically connected to the bleed passage 222 thus maintaining the scraper supply passage 264 at hydrostatic pressure.

Figure 24:
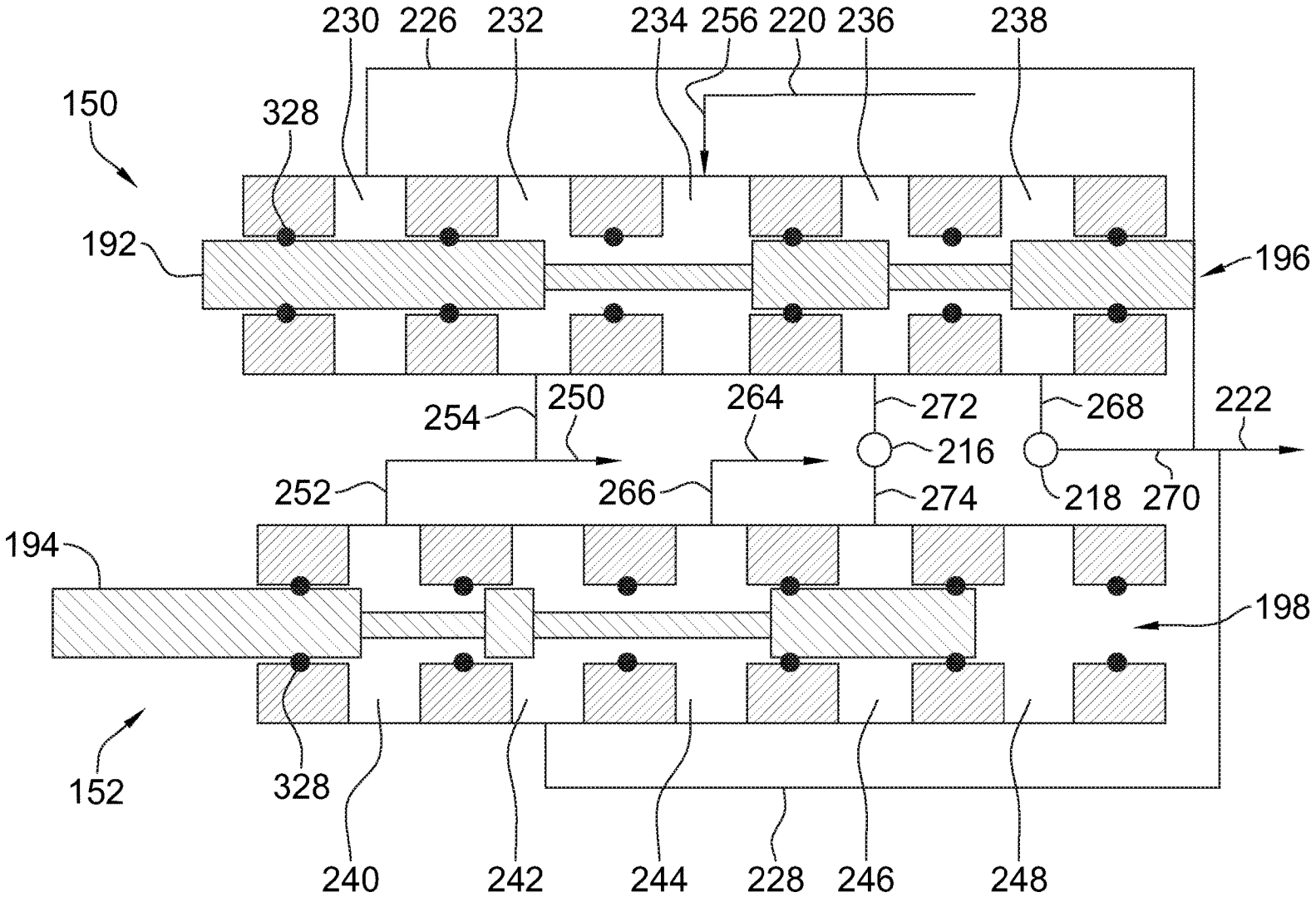
FIG. 24 is a schematic diagram of the valve manifold of the apparatus of FIG. 8 in a fourth position.

Turning now to FIG. 24, compressed gas 202 from the throttled compressed gas supply passage 220 enters the first valve 150 through the first compressed gas passage 256 into the third first-valve port 234. In the fourth operating position, as illustrated, the position of the first valve manifold rod 192 is set for a fluidic connection between the third first-valve port 234 and the second first-valve port 232. The second first-valve port 232 is fluidically connected to the injection supply passage 250 as well as to the first second-valve port 240. The second valve manifold rod 194 is set for fluidic connection between the first, second and third second-valve ports, 240, 242, and 244, respectively, in the fourth operating position. The second second-valve port 242 is fluidically connected to the bleed passage 222, while the third second-valve port 244 is fluidically connected to the scraper supply passage 264. Thus, in the fourth operating condition, the throttled compressed gas supply passage 220 and the injection supply passage 250 and the scraper supply passage 264 are all fluidically connected to the bleed passage 222. In this position, the compressed gas 202 within the compressed gas chamber 206 is bled into the surrounding hydrostatic fluid, resulting in a hydrostatic pressure throughout the apparatus 120.

Figure 25:
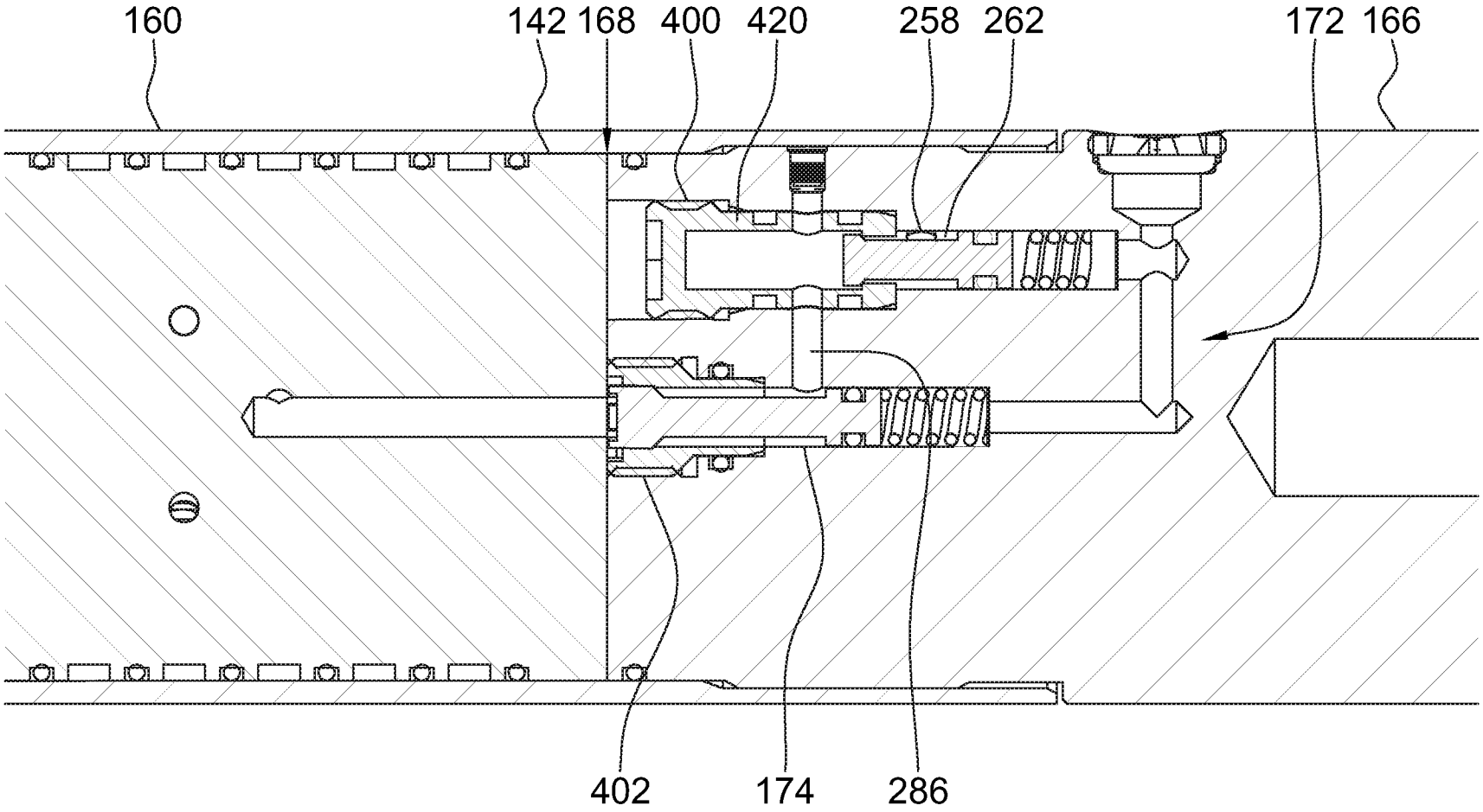
FIG. 25 is a detailed angled plane cross-sectional view of the throttle valve housing of the apparatus of FIG. 8 taken along the line 25-25 of FIG. 9.

Referring now to FIGS. 11 and 25, as set out above, the 2-stage throttle valve 172 is located within the throttle valve housing 166 proximate to the first end 168. The 2-stage throttle valve 172 is comprised of a first stage throttle valve 400 and a second stage throttle valve 402. The compressed gas 202 is received from the compressed gas chamber 206 through the compressed gas connection passage 258, as set out above, into the first stage throttle valve 400, where the pressure of the compressed gas 202 is regulated to a first stage pressure. The compressed gas 202 continues to the second stage throttle valve 402 through a connection passage 286 where the pressure is regulated to a second stage pressure before it is directed to the valves 150 and 152, as set out above. The compressed gas 202 is stored within the compressed gas chamber 206 at a pressure such as, by way of non-limiting example, 5000 psig. The first stage throttle valve 400 regulates the pressure of the compressed gas 202 to such as, by way of non-limiting example, 2500 psig and the second stage throttle valve 402 further regulates the pressure of the compressed gas 202 to such as, by way of non-limiting example, 200 psig, as well be set out further below.

Figure 26:
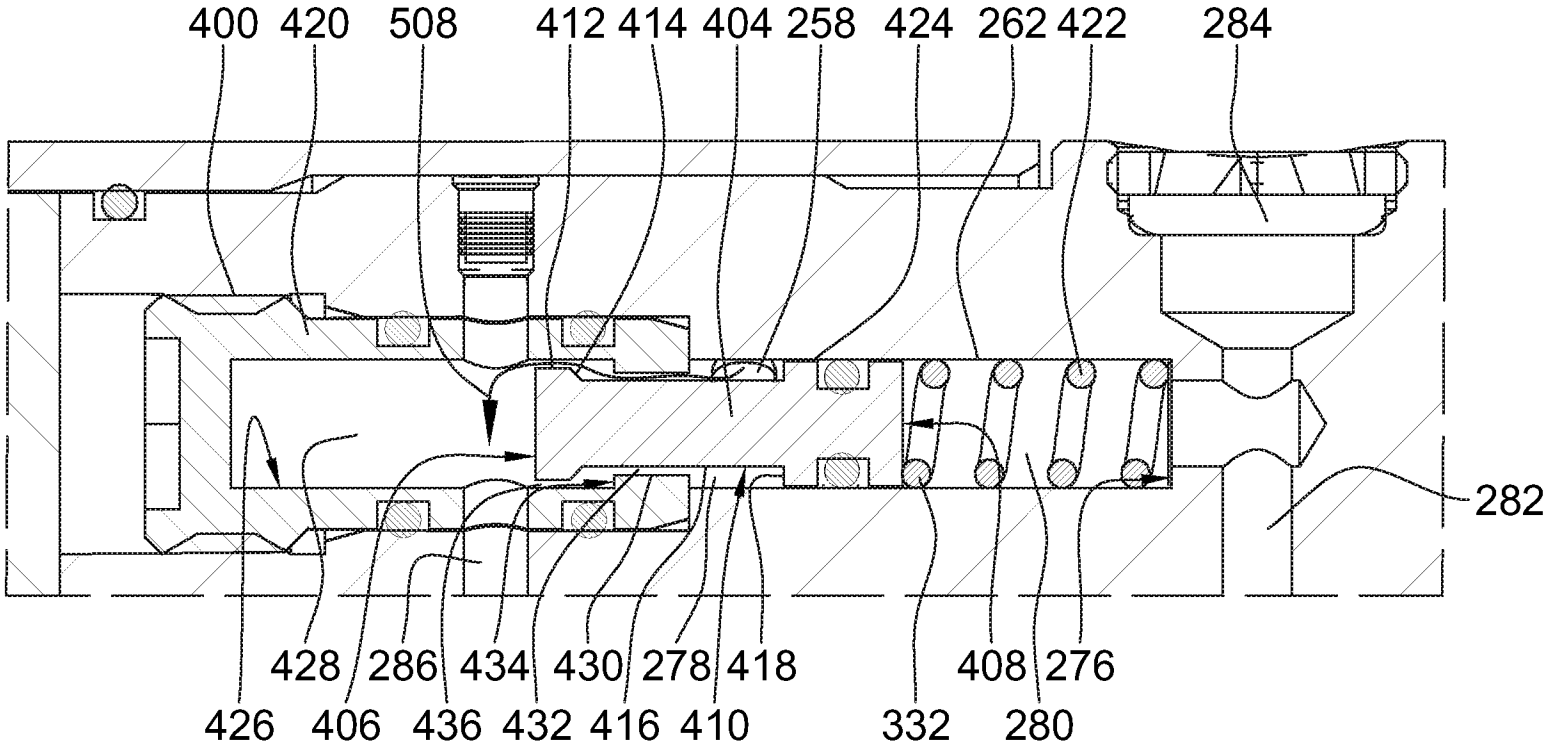
FIG. 26 is a detailed angled plane cross-sectional view of the first stage throttle valve of the apparatus of FIG. 8 taken along the line 25-25 of FIG. 9.

Referring now to FIG. 26, the first stage throttle valve 400 includes a first stage throttle valve plunger 404 having an outer surface 410 and extending between first and second ends, 406 and 408, respectively. The second end 408 of the first stage throttle valve plunger 404 is contained within the first stage throttle valve chamber 262 and the first end 406 is contained within a first stage throttle valve sleeve 420. A first stage throttle valve spring 422 is also contained within the first stage throttle valve chamber 262 and extends between the second end 408 of the first stage throttle valve plunger 404 and an inner annular shoulder 276 within the first stage throttle valve chamber 262. The first stage throttle valve plunger 404 includes a widened portion 412 at the first end 406 with a downwardly oriented annular ridge 414 separating the widened portion 412 from a narrow portion 416. The narrow portion 416 extends to an upright annular wall 418 defining a sealing portion 424 which extends to the second end 408 of the first stage throttle valve plunger 404. A seal 332 within the sealing portion 424 sealably separates the first stage throttle valve chamber 262 into pressurized and hydrostatic chambers, 278 and 280, respectively. The hydrostatic chamber 280 is fluidically connected to the surrounding hydrostatic fluid through a bleed passage 282 and filter 284. The pressurized chamber 278 is fluidically connected to the compressed gas chamber 206 through the compressed gas connection passage 258.

The first stage throttle valve sleeve 420 has an inner surface 426 forming a first stage throttling chamber 428 therein. The widened portion 412 of the first stage throttle valve plunger 404 extends into the first stage throttling chamber 428 through a throttle orifice 430. The throttle orifice 430 is sized to form an annular gap 432 between the outer surface 410 at the narrow portion 416 of the first stage throttle valve plunger 404 and the inner surface 426 at the throttle orifice 430. An inner annular shoulder 434 proximate to the throttle orifice 430 within the first stage throttling chamber 428 is sized such that the annular ridge 414 may engage thereupon, while providing a gap 436 between the widened portion 412 and the inner surface 426 of the first stage throttling chamber 428, allowing compressed gas to pass therethrough. The gap 436 is sized to meter the flow of compressed gas therethrough, as is commonly known. The first stage throttle valve 400 is connected to the second stage throttle valve 402 through the connection passage 286 which extends from the first stage throttling chamber 428.

As illustrated in FIG. 26, the compressed gas 202 flows through the first stage throttle valve 400 in a direction indicated generally at 508. The compressed gas 202 enters the first stage throttle valve 400 through the compressed gas connection passage 258 into the pressurized chamber 278 of the first stage throttle valve chamber 262. The compressed gas 202 flows through the gap 432 and through a variable gap between the annular ridge 414 and the annular shoulder 434, then through the gap 436 into the first stage throttling chamber 428. As is commonly known, a reduction in pressure is achieved by forcing gas flow through a resistance point, such as an orifice. The pressurized compressed gas 202 shifts the location of the first stage throttle plunger 404 by applying force to the upright annular wall 418 which is counteracted upon by the spring force of the first stage throttle valve spring 422. The first stage throttle valve spring 422 is selected to have a spring force which results in a pressure reduction such that the pressure of the compressed gas 202 in the first stage throttling chamber 428 is 2500 psig, as set out above.

Figure 27:
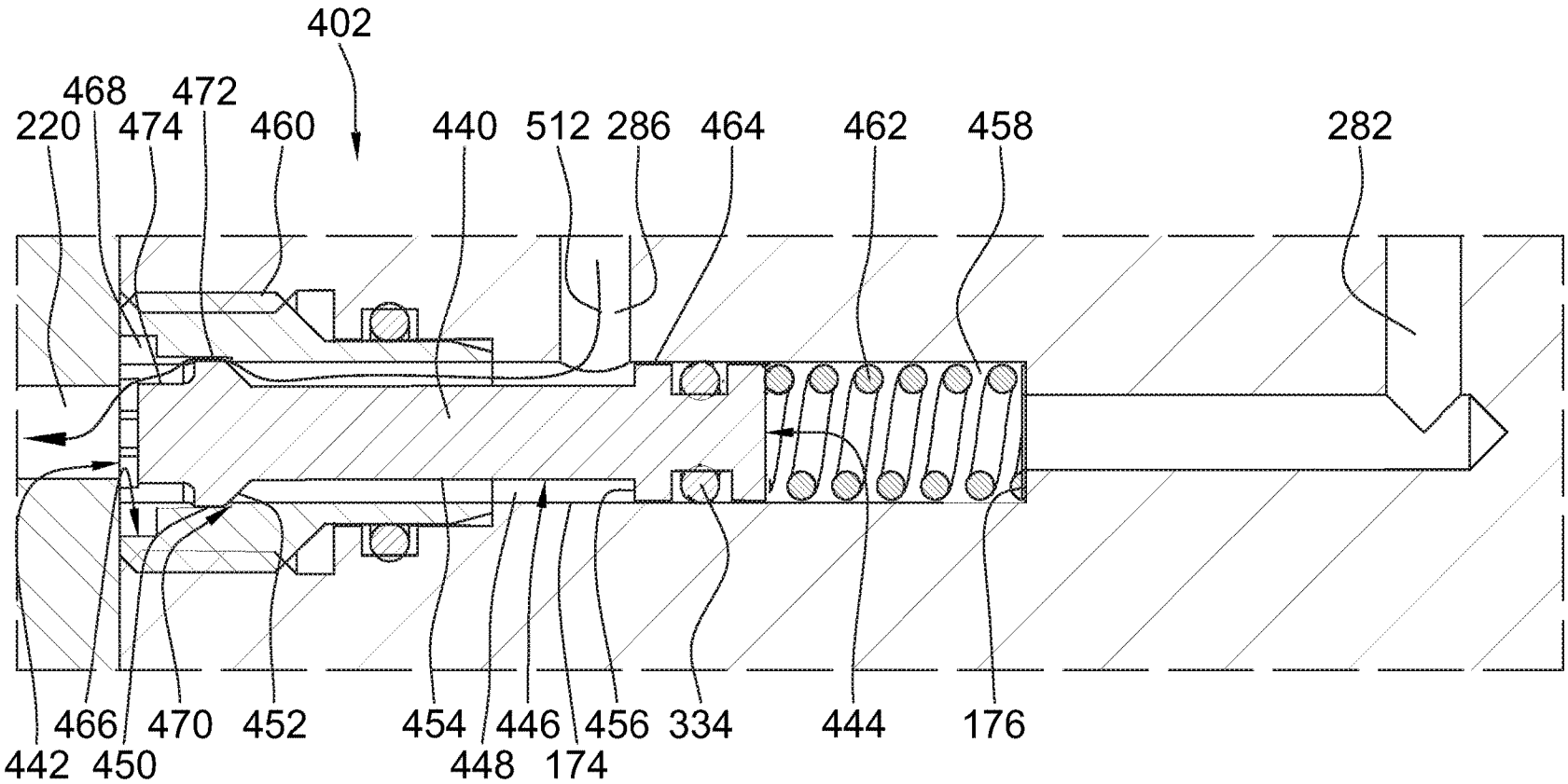
FIG. 27 is a detailed angled plane cross-sectional view of the second stage throttle valve of the apparatus of FIG. 8 taken along the line 25-25 of FIG. 9.

Turning now to FIG. 27, the second stage throttle valve 402 includes a second stage throttle valve plunger 440 having an outer surface 446 and extending between first and second ends, 442 and 444, respectively. The second end 444 of the second stage throttle valve plunger 440 is contained within the central throttle valve passage 174 and the first end 442 is contained within a second stage throttle valve sleeve 460. The first end 442 of the second stage throttle valve plunger 440 includes a plurality of axial notches 474. A second stage throttle valve spring 462 is also contained within the central throttle valve passage 174 and extends between the second end 444 of the second stage throttle valve plunger 440 and an inner annular shoulder 176 within the central throttle valve passage 174. The second stage throttle valve plunger 440 includes a widened portion 450 at the first end 442 with a downwardly oriented annular ridge 452 separating the widened portion 450 from a narrow portion 454. The narrow portion 454 extends to an upright annular wall 456 defining a sealing portion 464 which extends to the second end 444 of the second stage throttle valve plunger 440. A seal 334 within the sealing portion 464 sealably separates the central throttle valve passage 174 into pressurized and hydrostatic chambers, 448 and 458, respectively. The hydrostatic chamber 458 is fluidically connected to the surrounding hydrostatic fluid through the bleed passage 282 and filter 284, as set out above. The pressurized chamber 448 is fluidically connected to the first stage throttle valve 400 through the connection passage 286.

The second stage throttle valve sleeve 460 has an inner surface 466 forming a second stage throttling chamber 468 therein. The second stage throttling chamber 468 is fluidically connected with the notches 474 at the first end 442 of the second stage throttle valve plunger 440 and with the throttled compressed gas supply passage 220. The widened portion 450 of the second stage throttle valve plunger 440 extends into the second stage throttling chamber 468 and is retained therein with an inner annular shoulder 470. An annular gap 472 is formed between the outer surface 446 at the widened portion 450 of the second stage throttle valve plunger 440 and the inner surface 466 of the second stage throttle valve sleeve 460. The annular shoulder 470 is sized such that the annular ridge 452 may engage thereupon, forming a variable gap therebetween allowing compressed gas to pass therethrough. The annular gap 472 is sized to meter the flow of compressed gas therethrough, as is commonly known. The first stage throttle valve 400 is connected to the second stage throttle valve 402 through the connection passage 286 which extends from the first stage throttling chamber 428.

As illustrated in FIG. 27, the compressed gas 202 flows through the second stage throttle valve 402 in a direction indicated generally at 512. The compressed gas 202 enters the second stage throttle valve 402 through the connection passage 286 into the pressurized chamber 448 of the central throttle valve passage 174. The compressed gas 202 flows through the variable gap between the annular ridge 452 and the annular shoulder 470, then through the gap 472 and through the notches 474 into the second stage throttling chamber 468 and into the throttled compressed gas supply passage 220. As is commonly known, and as set out above, a reduction in pressure is achieved by forcing gas flow through a resistance point, such as an orifice. The pressurized compressed gas 202 shifts the location of the second stage throttle valve plunger 440 by applying force to the upright annular wall 456 which is counteracted upon by the spring force of the second stage throttle valve spring 462. The second stage throttle valve spring 462 is selected to have a spring force which results in a pressure reduction such that the pressure of the compressed gas 202 in the second stage throttling chamber 468 is 200 psig, as set out above.

Figure 28:
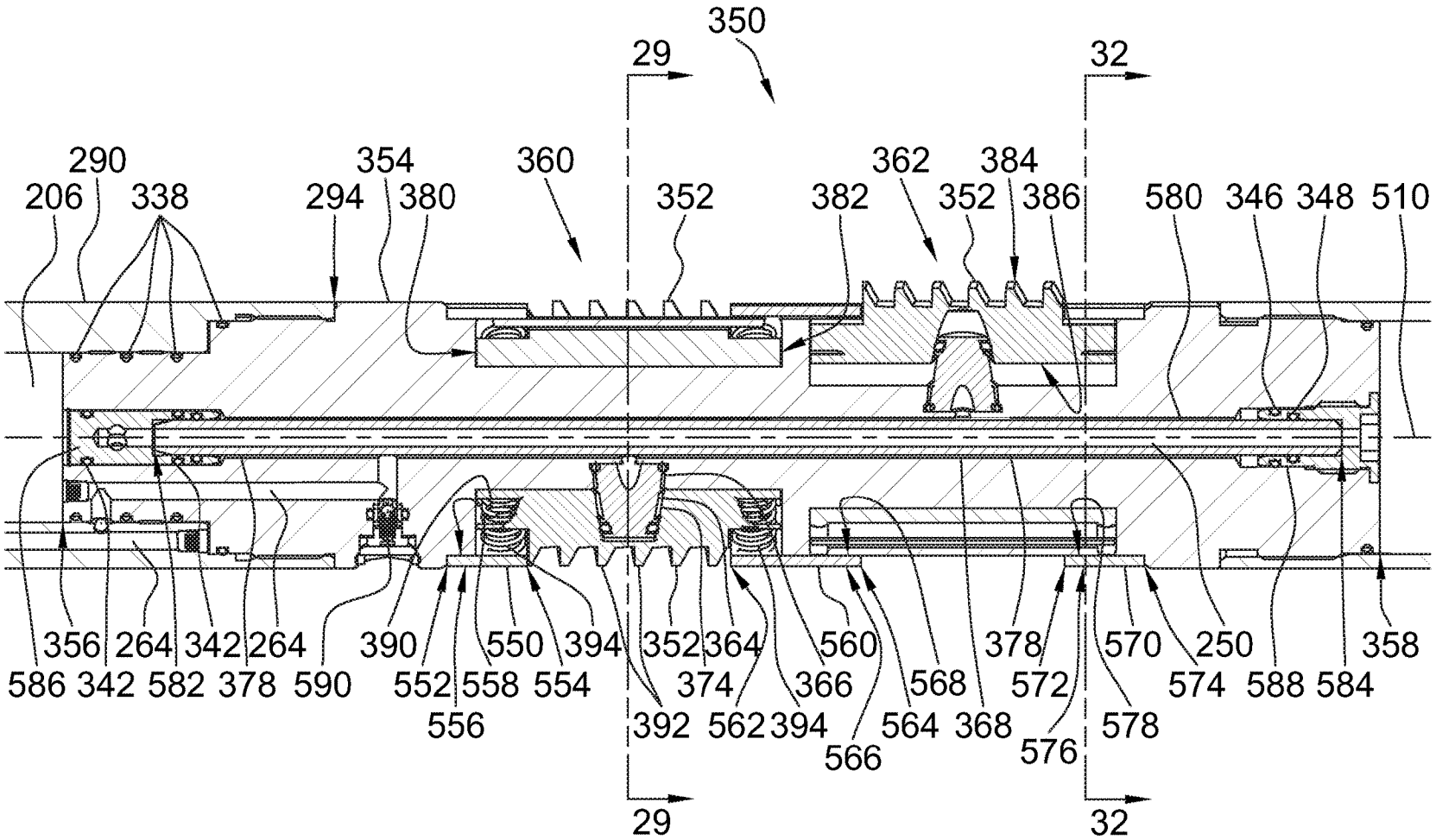
FIG. 28 is a detailed angled plane cross-sectional view of the scraper section of the apparatus of FIG. 8 taken along the line 16-16 of FIG. 9.

As illustrated in FIG. 10, the compressed gas housing 290 extends between first and second ends 292 and 294, respectively. As illustrated in FIG. 11, the first end 292 of the compressed gas housing 290 is sealably secured to the second end 170 of the throttle valve housing 166 with a plurality of seals 336 therebetween. The compressed gas housing 290 is secured to the throttle valve housing 166 by means as are commonly known, such as, by way of non-limiting example, threading or the like. As illustrated in FIG. 28, the scraper section 350 includes a scraper housing 354 which extends between first and second ends 356 and 358, respectively. The second end 294 of the compressed gas housing 290 is sealably secured to the first end 356 of the scraper housing 354 by means as are commonly known, such as, by way of non-limiting example, threading or the like, with a plurality of seals 338 therebetween.

Referring to FIGS. 16 and 28, the scraper supply passage 264 passes from the valve manifold housing 142, through the throttle valve housing 166 and through the compressed gas housing 290 into the scraper housing 354.

Figure 29:
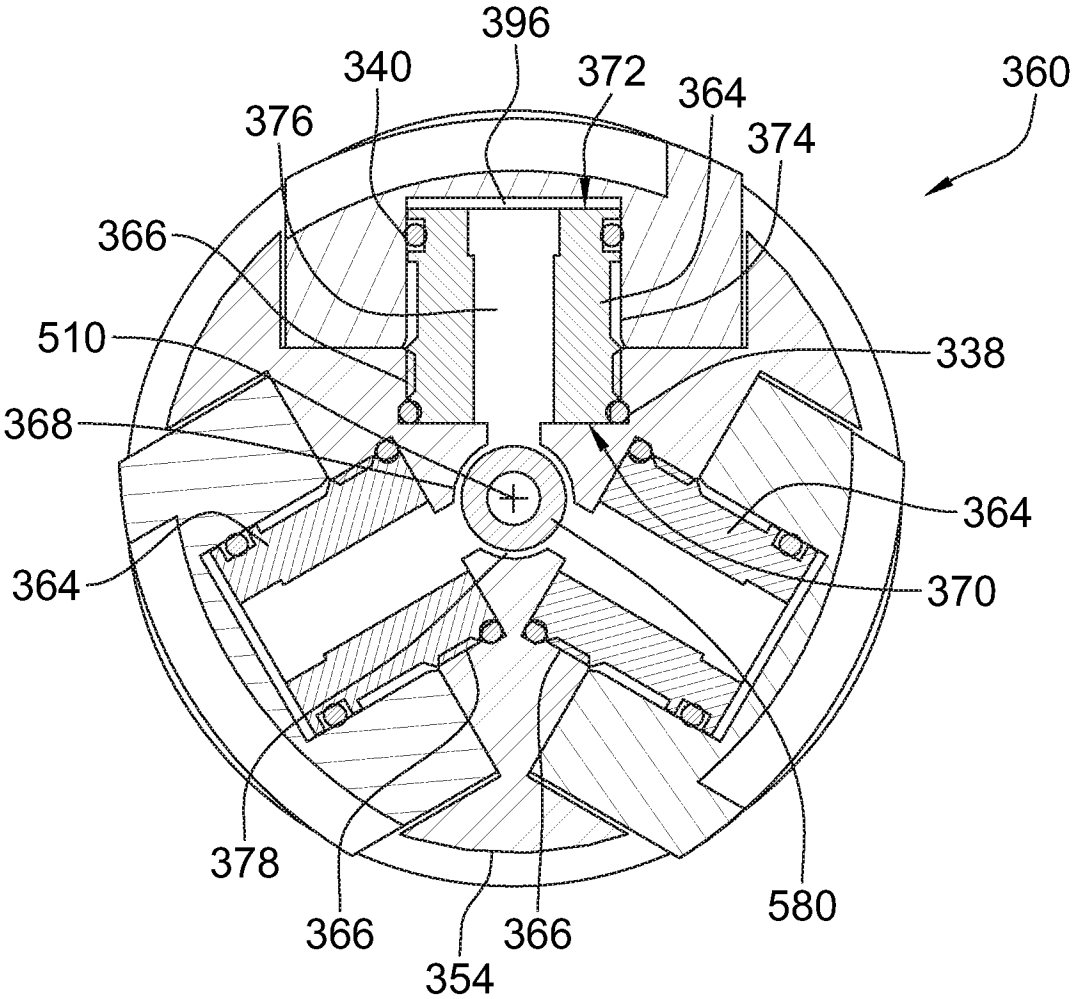
FIG. 29 is a radial cross-sectional view of the scraper housing of the apparatus of FIG. 8 with the scrapers in a retracted position, as taken along the line 29-29 of FIG. 28.

Referring to FIGS. 28 through 32, a plurality of scrapers 352 are supported on the scraper housing 354 at first and second scraper assemblies, 360 and 362, respectively. A central mandrel 580 extends between first and second ends 582 and 584, respectively, along the central axis 510 within a central axial bore 368 which extends between the first and second ends, 356 and 358, respectively, of the scraper housing 354. As best illustrated in FIG. 29, the central mandrel 580 is sized such that the axial bore 368 and the central mandrel 580 form an annular passage 378 therebetween, the purpose of which will be set out further below.

Each scraper assembly, 360 and 362, includes three scrapers 352 rotationally separated by 120 degrees about the central axis 510. The scraper assemblies 360 and 362 are formed in a similar manner with an offset from each other of 60 degrees such that the first and second scraper assemblies 360 and 362 together include scrapers 352 covering the full 360 degrees around the central axis 510 of the apparatus 120. A radial scraper piston 364 is secured within a radial bore 366 in the scraper housing 354 corresponding to each scraper 352, as best illustrated in FIG. 29. Each radial bore 366 is fluidically connected to the annular passage 378, the purpose of which will be set out further below. Each radial scraper piston 364 extends between first and second ends, 370 and 372, respectively, with the first end 370 sealably secured within the radial bore 366 by means as are commonly known, such as, by way of non-limiting example, threading or the like, and a seal 338 therebetween. The second end 372 of each radial scraper piston 364 is slideably retained within a scraper extension bore 374 within the corresponding extendable scraper 352 with a seal 340 therebetween. Each radial scraper piston 364 includes a central passage 376 therethrough.

Figure 31:
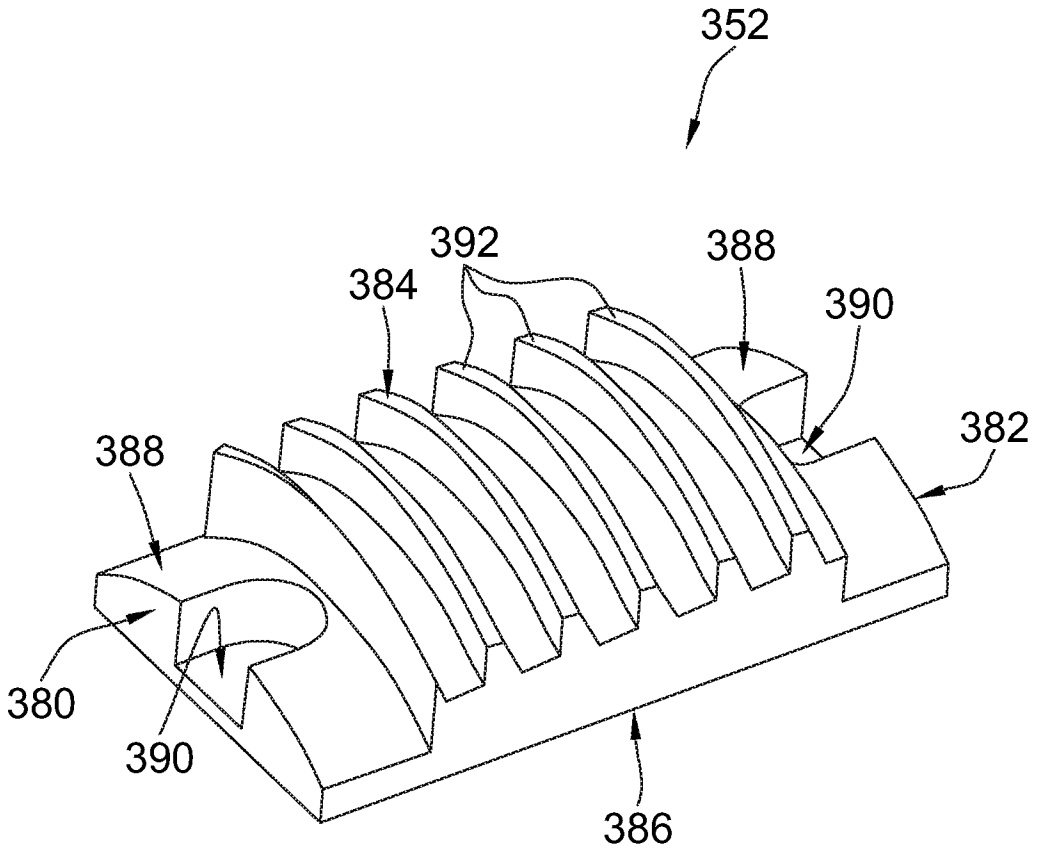
FIG. 31 is a perspective view of a scraper of the apparatus of FIG. 8.
Figure 32:
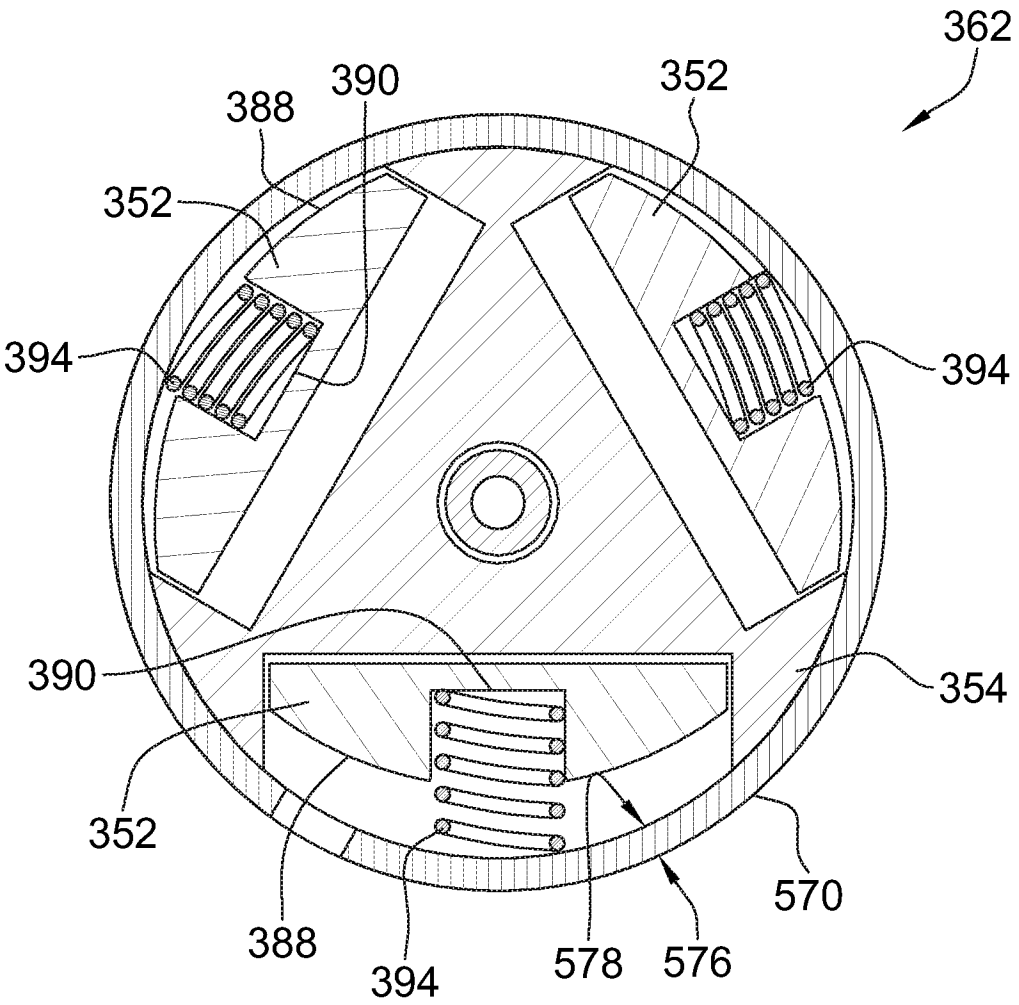
FIG. 32 is a radial cross-sectional view of the scraper housing of the apparatus of FIG. 8 with two scrapers in an extended position and on scraper in a retracted position, as taken along the line 32-32 of FIG. 28.

As illustrated in FIGS. 28 and 31, Each scraper 352 extends between first and second ends, 380 and 382, respectively with upper and lower surfaces, 384 and 386, respectively. Each scraper 352 includes a retention portion 388 with a spring seat 390 formed in the upper surface 384 at each of the first and second ends, 380 and 382, as shown in FIGS. 31 and 32. A plurality of circumferential scraper ridges 392 extend from the upper surface 384 between the two retention portions 388. The scraper ridges 392 are formed to correspond with the interior surface of the casing 8 such that when the scrapers 352 are extended, as will be set out below, they will contact the casing 8 such that any debris collected thereon may be engaged upon by the scraper ridges 392. The scraper extension bore 374 is formed in the lower surface 386 of each scraper 352, centered between the first and second ends, 380 and 382, to correspond with the radial scraper piston 364, and forms an extension cavity 396 therein.

Turning now to FIG. 28, a first scraper retention collar 550 extends between first and second ends, 552 and 554, respectively, with outer and inner surfaces, 556 and 558, respectively. The first scraper retention collar 550 engages upon the scraper housing 354 at the first end and the second end 554 extends over the retention portion 388 at the first end 380 of the three scrapers 352 in the first scraper assembly 360. A retraction spring 394 extends radially from within each spring seat 390 at the first end 380 of each scraper 352 in the first scraper assembly 360 to the inner surface 558 of the first scraper retention collar 550 proximate to the second end 554.

A second scraper retention collar 560 extends between first and second ends, 562 and 564, respectively, with outer and inner surfaces, 566 and 568, respectively. The first end 562 of the second scraper retention collar 560 extends over the retention portion 388 at the second end 382 of the scrapers 352 in the first scraper assembly 360, while the second end 564 extends over the retention portion 388 at the first end 380 of the scrapers 352 in the second scraper assembly 362, and the second scraper retention collar 560 engages upon the scraper housing 354 at a middle portion therebetween. Retraction springs 394 extend radially from within the spring seats 390 at the second end 382 of each scraper 352 in the first scraper assembly 360 to the inner surface 568 of the second scraper retention collar 560 proximate to the first end 562, and retraction springs 394 extend radially from within the spring seats 390 at the first end 380 of each scraper 352 in the second scraper assembly 362 to the inner surface 568 of the second scraper retention collar 560 proximate to the second end 564.

A third scraper retention collar 570 extends between first and second ends, 572 and 574, respectively, with outer and inner surfaces, 576 and 578, respectively. The first end 572 of the third scraper retention collar 570 extends over the retention portion 388 at the second end 382 of the scrapers 352 in the second scraper assembly 362, while the second end 574 engages upon the scraper housing 354. Retraction springs 394 extend radially from within the spring seats 390 at the second end 382 of each scraper 352 in the second scraper assembly 362 to the inner surface 578 of the third scraper retention collar 570 proximate to the first end 572.

The third scraper retention collar 570 and second scraper assembly 362 are illustrated in cross section in FIG. 32 through the retention portion 388 at the second end 382 of the scrapers 352. It will be appreciated that for illustration purposes only, the top two scrapers 352 are illustrated in an extended position, while the bottom scraper 352 is illustrated in a retracted position. In operation, all scrapers 352 would be in either the extended or retracted position. The retraction springs 394 are compression springs, as are commonly known, and offer resistance to compressive forces. When the scrapers 352 are in an extended position, the retraction springs 394 are compressed, as illustrated on the top two scrapers 352 in FIG. 32, providing a spring force between the inner surface 578 of the third scraper retention collar 570 and the upper surface 384 of the scrapers 352 within the spring seats 390.

Figure 33:
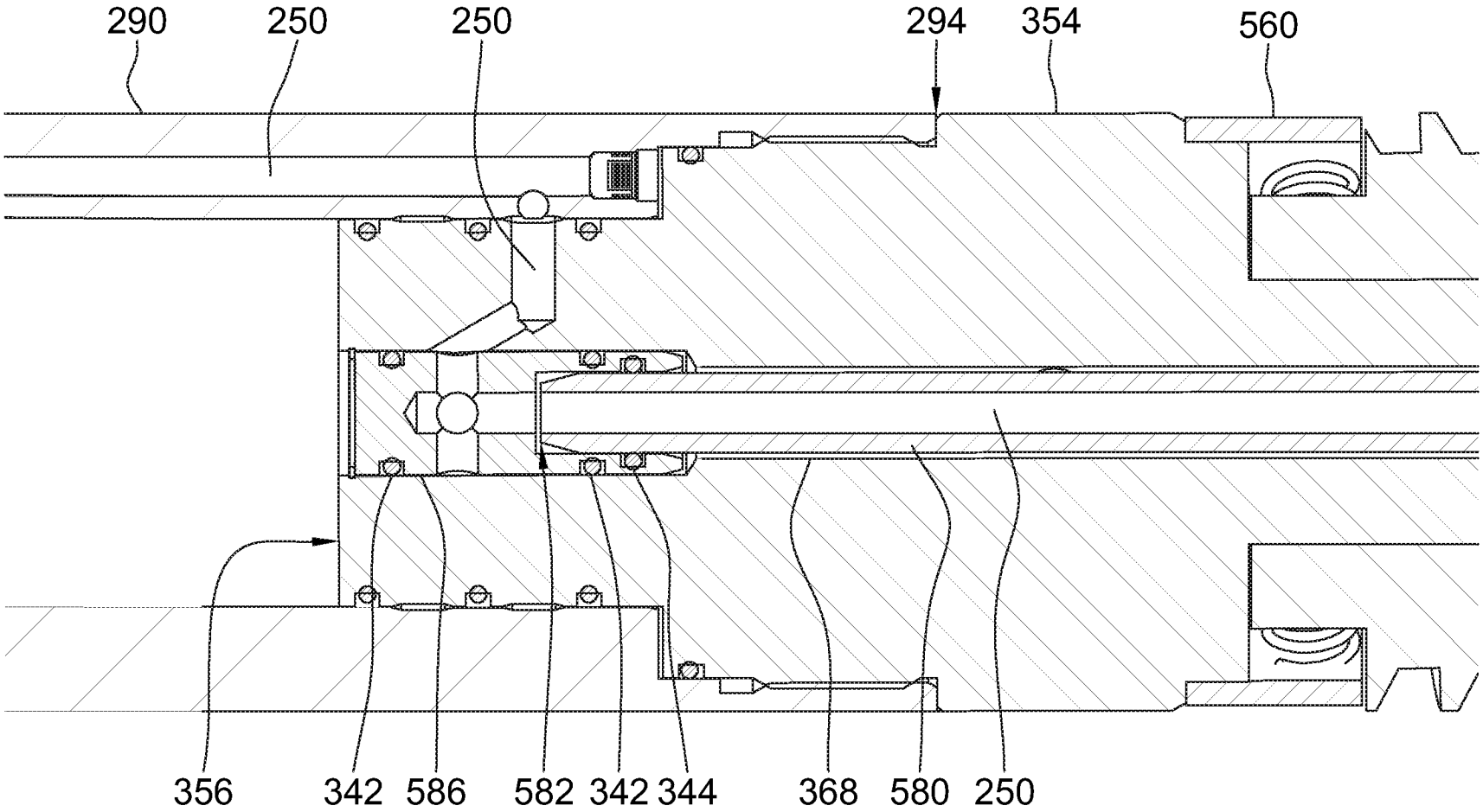
FIG. 33 is a detailed top plane cross-sectional view of the scraper housing of the apparatus of FIG. 8 taken along the line 13-13 of FIG. 9.

Referring to FIGS. 13 and 33, the injection supply passage 250 passes from the valve manifold housing 142, through the throttle valve housing 166 and through the compressed gas housing 290 into the scraper housing 354. As illustrated in FIGS. 28 and 33, a first end plug 586 is sealably retained within the central axial bore 368 proximate to the first end 356 with seals 342 between the first end plug 586 and the scraper housing 354. The first end 582 of the central mandrel 580 is sealably retrained within the first end plug 586 with a seal 344 therebetween. As best illustrated in FIG. 33, the injection supply passage 250 continues from the scraper housing 354 through the first end plug 586 and through the center of the central mandrel 580. Referring to FIG. 28, a second end plug is sealably retained within the central axial bore 368 proximate to the second end 358 with a seal 346 between the second end plug 588 and the scraper housing 354. The second end 584 of the central mandrel 580 is sealably retrained within the second end plug 588 with a seal 348 therebetween. The injection supply passage 250 is thus sealably separated from the annular passage 378.

Figure 30:
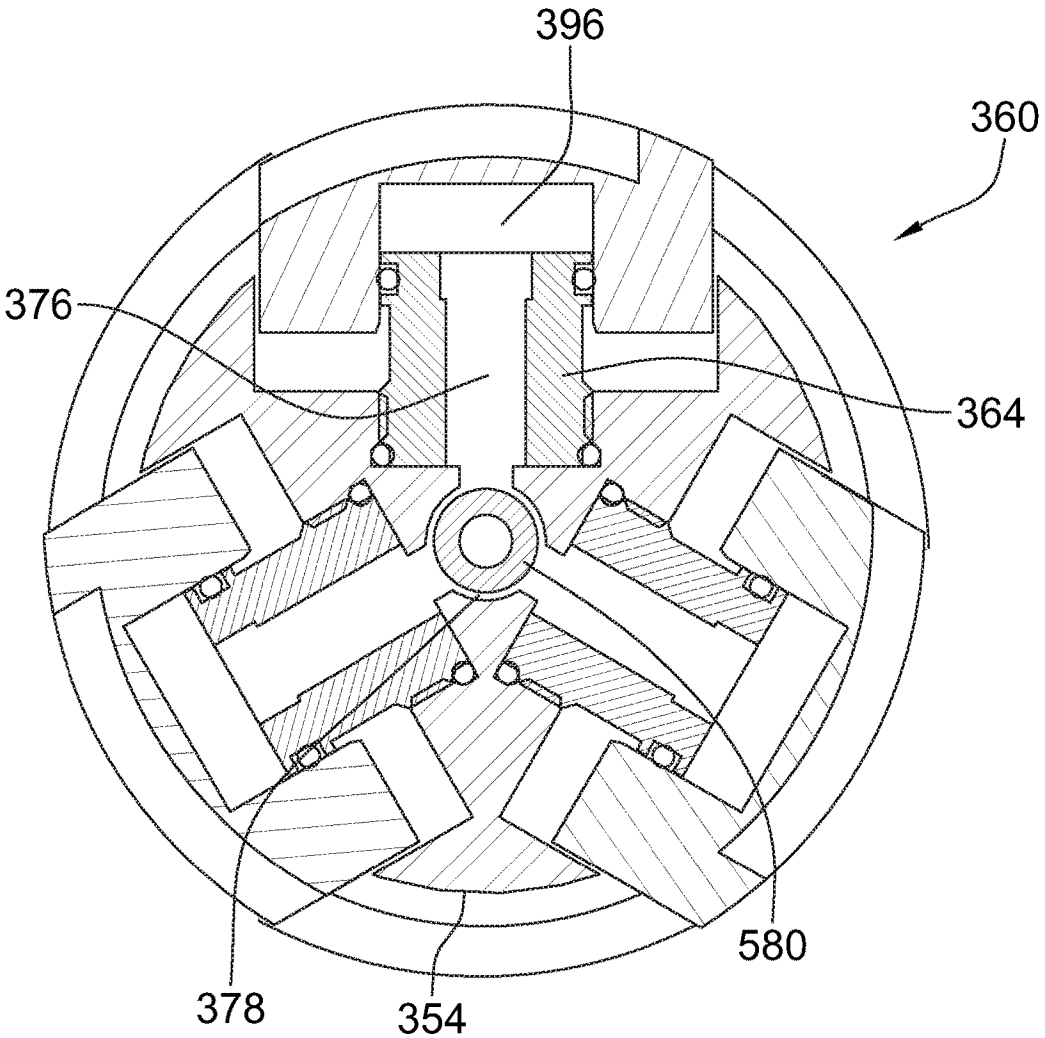
FIG. 30 is a radial cross-sectional view of the scraper housing of the apparatus of FIG. 8 with the scrapers in an extended position, as taken along the line 29-29 of FIG. 28.

Referring now to FIG. 28, as set out above, the scraper supply passage 264 extends into the scraper housing 354. The scraper housing 354 includes a check valve 590 fluidically connecting the scraper supply passage 264 with the surrounding hydrostatic fluid. The check valve 590 is selected to allow flow in one direction only, from the scraper supply passage 264 into the surrounding hydrostatic fluid, when the pressure within the scraper supply passage 264 reaches a threshold pressure, such as, by way of non-limiting example, 300 psig. The scraper supply passage 264 is fluidically connected to the annular passage 378. As set out above, and as illustrated in FIGS. 29 and 30, the annular passage 378 is fluidically connected to the central passage 376 within each radial scraper piston 364.

As set out above, throttled compressed gas 202 may be selectively directed to the scraper supply passage 264 by setting the first and second valves 150 and 152 to the second position, as illustrated in FIG. 22. When pressurized compressed gas 202 is directed through the scraper supply passage 264, the compressed gas 202 passes through the annular passage 378 and through the central passages 376 to the extension cavities 396 within the scrapers 352. When the pressure of the compressed gas 202 exceeds the spring force of the two retraction springs 394 on each scraper 352, the compressed gas 202 shifts the scrapers 352 from the retracted position, as illustrated in FIG. 29, to the extended position, as illustrated in FIG. 30, thereby filling the extension cavities 396.

Figure 34:
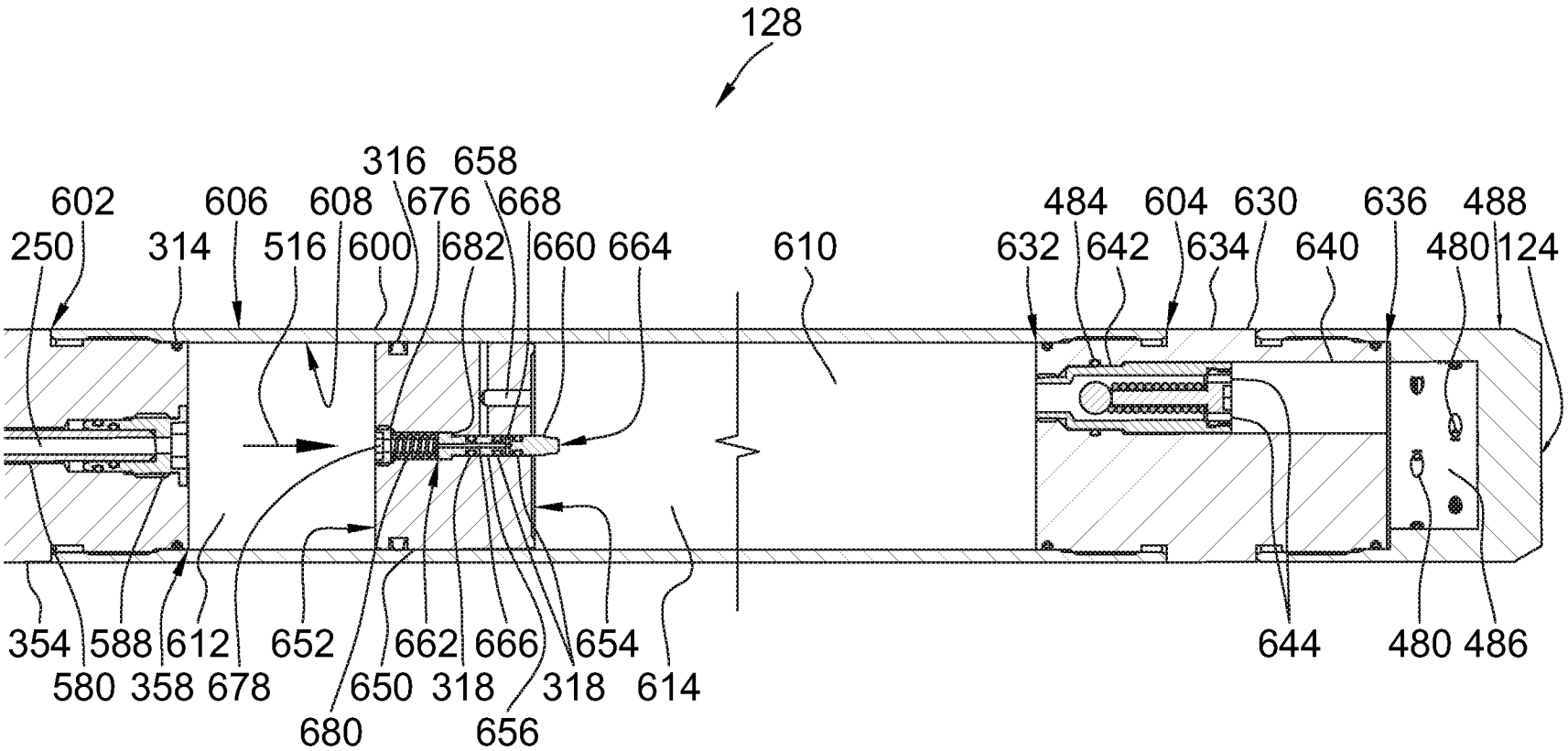
FIG. 34 is a detailed top plane cross-sectional view of the injection section of the apparatus of FIG. 8 in an injecting position taken along the line 13-13 of FIG. 9.

Turning now to FIG. 34, the injection section 128 is comprised of a tubular piston housing 600 extending between first and second ends, 602 and 604, respectively, with an injection assembly 630 connected thereto at the second end 604. The first end 602 is sealably secured to the second end 358 of the scraper housing 354 by means as are commonly known, such as, by way of non-limiting example, threading or the like, with a seal 314 therebetween. The injection assembly 630 extends between a first end 632 and the second end 124 and includes the nozzles 480 extending therethrough, as will be set out below.

The piston housing 600 includes outer and inner surfaces, 606 and 608, respectively, and forms the cavity 610 therein. The piston 650 is sealably retained in the piston housing 600 with a piston seal 316 therebetween. The piston housing 600 may be comprised of two or more joined cylindrical portions, allowing for volume capacity adjustment of the cavity 610. It will be appreciated that for illustration purposes, only a portion of the piston housing 600 is shown in FIG. 34. The piston 650 includes first and second surfaces 652 and 654, respectively, and separates the cavity 610 into first and second cavities 612 and 614, respectively.

Referring to FIGS. 13, 28, 33 and 34, the injection supply passage 250 passes from the valve manifold housing 142, through the throttle valve housing 166, through the compressed gas housing 290, through the scraper housing 354 and through the central mandrel 580 and second end plug 588. The injection supply passage 250 is fluidically connected to the first cavity 612 through the second end plug 588.

The piston 650 includes a central bore 656 therethrough containing a bypass pin 660 therein. The central bore 656 is fluidically connected with a bypass passage 658 within the piston 650, which is fluidically connected with the second cavity 614. As best shown on FIG. 35, the bypass pin 660 extends between first and second ends, 662 and 664, respectively, and includes an annular wall 670 separating a wide portion 672 extending from the first end 662 from a narrow sealing portion 674 extending to the second end 664. The sealing portion 674 includes a plurality of seals 318 thereon. The bypass pin 660 includes an axial bypass passage 666 therein, extending from the first end 662 to a radial bypass passage 668 extending radially through the bypass pin 660 at a location on the sealing portion 674 between two seals 318.

A first end spring seat 676 with a central passage 678 therethrough is secured within the central bore 656 proximate to the first surface 652 of the piston 650. The central passage 678 fluidically connects the first cavity 612 with the axial bypass passage 666 within the bypass pin 660. A pin spring 680 extends between the first end spring seat 676 and the first end 662 of the bypass pin 660. As illustrated in FIG. 34, the pin spring 680 provides a spring force, as is commonly known, to position the bypass pin 660 such that the annular wall 670 engages upon an inner annular wall 682 within the central bore 656. In this position the radial bypass passage 668 is sealably separated from the bypass passage 658, thus the first and second cavities, 612 and 614, respectively, are sealably separated.

The injection assembly 630 includes a valve housing 634 extending from the first end 632 to a second end 636 with a nozzle housing 686 sealably secured thereto with a seal 482 therebetween. The first end 632 of the injection assembly 630 is sealably secured to the to the second end 604 of the piston housing 600 with a seal 484 therebetween. The valve housing 634 includes an axial bore 640 therethrough with a check valve 642 sealably retained therein with a seal 484 therebetween. The check valve 642 is formed as is commonly known, and includes a plurality of passages 644 therethrough. It will be appreciated that, for illustration purposes, the check valve 642 is illustrated in an open position in FIGS. 34 and 35, indicating that pressure is applied to the check valve 642 to force it open and to fluidically connect the second cavity 614 with the nozzles 480. Although a check valve 642 is illustrated in the present embodiment of the invention, it will be appreciated that other selectable retention means may be used, as well, such as, by way of non-limiting example, a flap valve or breakable seal.

The nozzle housing 638 includes a central cavity 486 therein, fluidically connected to the nozzles 480. The check valve 642 within the valve housing 634 is adapted to selectably fluidically connect the second cavity 614 with the nozzles 480. The check valve 642 may include an optional filter thereon.

Figure 36:
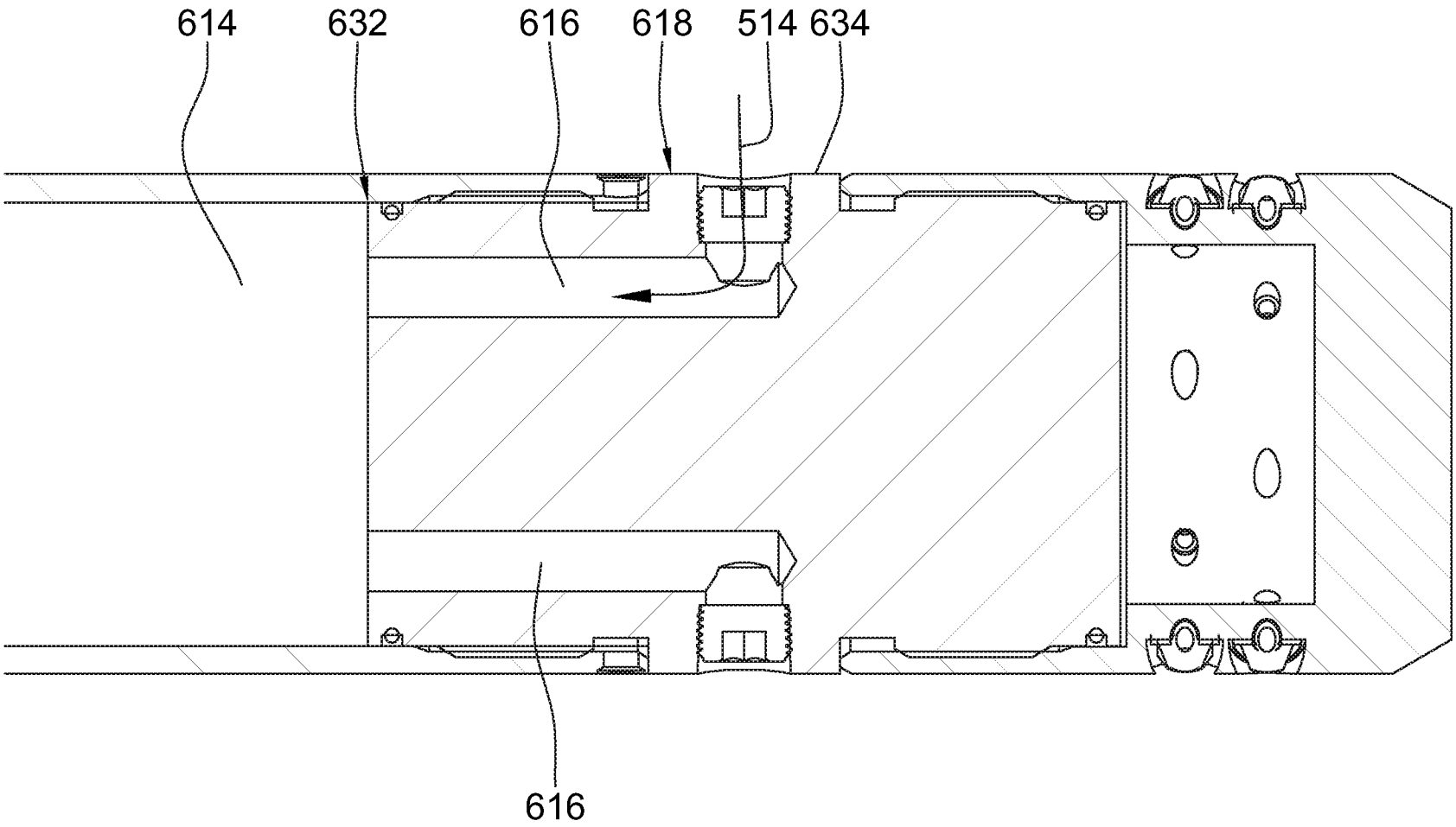
FIG. 36 is a is a detailed side plane cross-sectional view of the injection assembly of the apparatus of FIG. 8 taken along the line 10-10 of FIG. 9.

As illustrated in FIG. 36, the valve housing 634 includes at least one fill port passage 616 extending therethrough from an outer surface 618 to the first end 632, providing a fluidic connection from the outside of the apparatus 120 to the second cavity 614. The fill port passage 616 may include an ORB fill port/check valve, as is commonly known, such that the contents of the second cavity 614 may pass in one direction only, generally indicated at 514, through the fill port passage 616 into the second cavity 614.

The plurality of nozzles 480 extend through the nozzle housing 638 between the central cavity 486 and an outer surface 488 such that the nozzles 480 are oriented in a direction generally towards the casing 8. The nozzles 72 may be oriented at any angle.

As set out above, throttled compressed gas 202 may be selectively directed to the injection supply passage 250 by setting the first and second valves 150 and 152 to the third operating position, as illustrated in FIG. 23.

When compressed gas 202 is directed into the injection supply passage 250, it enters the first cavity 612 and the pressure of the compressed gas 202 acts upon the first surface 652 of the piston 650, thereby shifting the piston within the cavity 610 in a direction generally indicated at 516 in FIG. 34. As the piston 650 shifts within the cavity 610, the second surface 654 applies force to the contents of the second cavity 614, thereby opening the check valve 642 and pushing the contents of the second cavity 614 through the check valve 642, through the passages 644, into the central cavity 486 and out through the nozzles 480 such that the contents of the second cavity 614 impact the casing 8. It will be appreciated that the nozzles 480 are oriented such that the wellbore fluid is displaced upward within the wellbore, thereby reducing contamination and further improving bonding to the casing 8.

Figure 35:
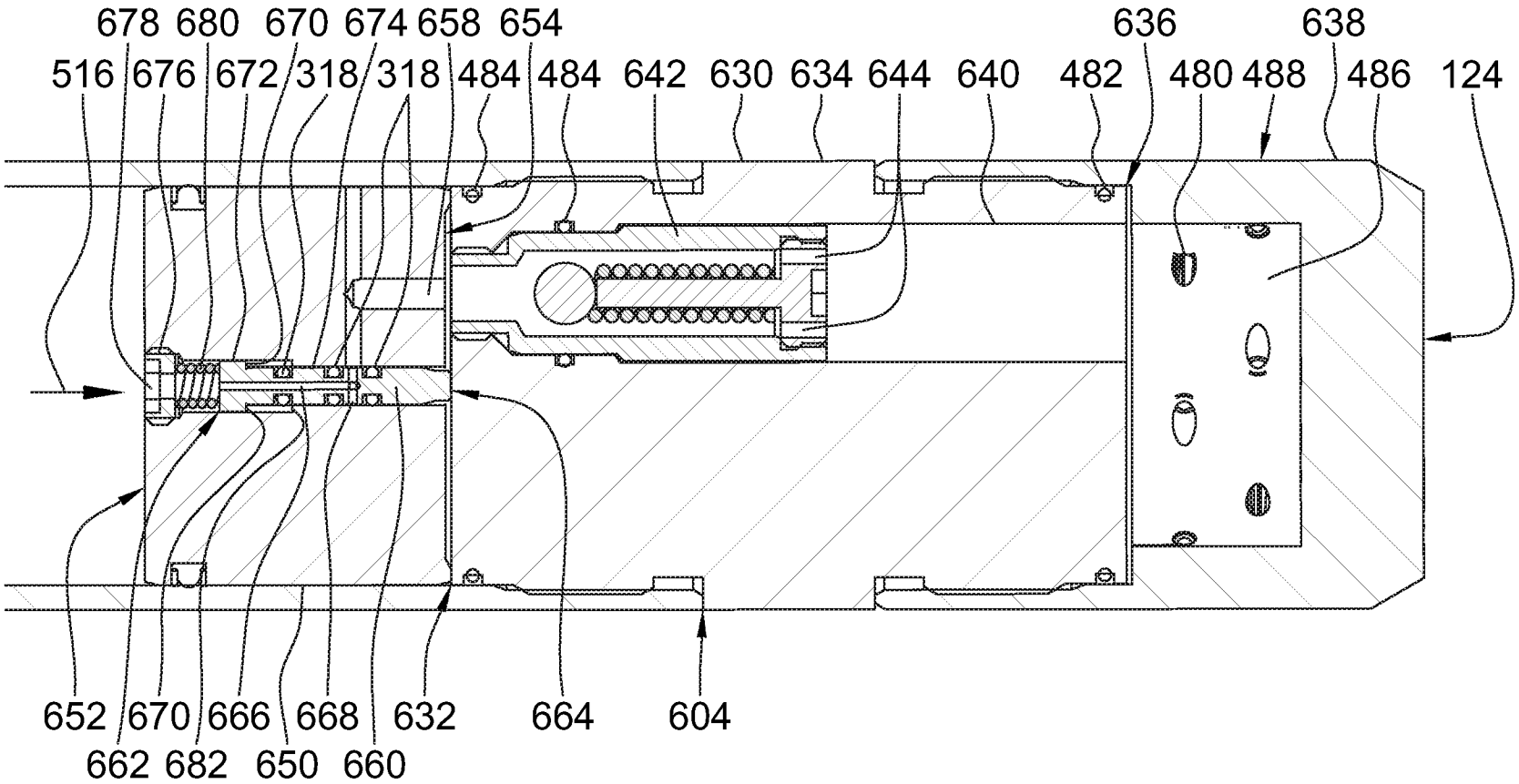
FIG. 35 is a detailed top plane cross-sectional view of the injection section of the apparatus of FIG. 8 with the piston in a flushing position taken along the line 13-13 of FIG. 9.

The piston 650 continues to shift in the direction indicated at 516 until the second end 664 of the bypass pin 660 engages upon the first end 632 of the injection assembly 630, as illustrated in FIG. 35. With continued applied pressure, the piston 650 continues to move in the direction indicated at 516 until the second surface 654 engages upon the first end 632 of the injection assembly 630. The pin spring 680 compresses and the bypass pin 660 shifts within the central bore 656 until the radial bypass passage 668 is aligned with the bypass passage 658 such that the compressed gas 202 may pass therethrough.

As illustrated in FIG. 35, the bypass passage 658 is aligned with the check valve 642. Continued supply of compressed gas 202 passes through the axial bypass passage 666 and the radial bypass passage 668 and through the bypass passage 658 into and through the check valve 642 such that the compressed gas 202 fills the central chamber 486 and passes out of the apparatus 120 through the nozzles 480. This flushes the nozzles 480. As the compressed gas 202 is depleted, the pressure decreases and the spring force of the pin spring 680 eventually overcomes the pressure of the compressed gas 202 and shifts the bypass pin 660 within the central bore 656, moving the piston 650 away from the injection assembly 630. As the pin spring 680 shifts within the central bore 656, the radial bypass passage 668 is moved away from the bypass passage 658 such that they are sealably separated and no longer in fluidic communication.

To prepare the apparatus 120 for operation, the first and second valves 150 and 152 are set to the first operating position, as illustrated in FIG. 21, such that the compressed gas 202 is blocked, with the scraper supply passage 264 and injection supply passage 250 open to the bleed passage 222. In this position, the compressed gas chamber 206 may be filled.

The compressed gas chamber 206 is filled with compressed gas 202 through the first compressed gas passage 256, which is fluidically connected to the second compressed gas passage 260 through the compressed gas connection passage 258, as illustrated in FIG. 17, with the second compressed gas passage 260 fluidically connected to the compressed gas chamber 206, as illustrated in FIG. 11.

The second cavity 614 is initially filled with the cleaning fluid 204 through the fill port passages 616 illustrated in FIG. 36. As the second cavity 614 is filled, the piston 650 is shifted towards the first end 602 of the piston housing 600.

The apparatus 120 is then positioned within the well 6 at a desired location and a signal is sent through the wireline 4, as is commonly known. The control and activation section 126 sends a signal to the first and second electric motors 154 and 156, activating the motors 154 and 156 and shifting the first and second first and second valve manifold rods 192 and 194 of the valves 150 and 152 within the first and second valve manifold cavities 196 and 198, as set out above.

Once in position, the first and second valves 150 and 152 are set to the second position, as illustrated in FIG. 22, with the compressed gas 202 directed to the scraper supply passage 264 such that the scrapers 352 are extended, as set out above. With the scrapers 352 extended, the apparatus 120 may be mechanically moved within the well 6 by raising and lowering the wireline 4 such that the scrapers 352 engage upon the casing 8 and scraper off any debris accumulated there.

After scraping debris from the casing 8, the first and second valves 150 and 152 are set to the third operating position, with the compressed gas 202 directed to the injection supply passage 250, as set out above. In this position, the cleaning fluid 204 is jetted out of the nozzles 480 at a high pressure and velocity to further clean the casing 8 and to prepare it for cement bonding. The apparatus 120 may be mechanically moved within the well 6 by raising and lowering the wireline 4 while the cleaning fluid 204 is jetted out of the nozzles 480.

After the cleaning fluid 204 is depleted from the cavity 610, the first and second valves 150 and 152 are set to the fourth position, with the compressed gas 202, scraper passage 264 and injection supply passage 250 all connected to the bleed passage 222, as set out above. In this position, the compressed gas 202 within the apparatus 120 is bled out until it reaches hydrostatic pressure, for safety purposes. The apparatus 120 may then be returned to the surface to prepare for the sealing procedure.

As set out above, the first and second valves 150 and 152 are set to the first operating position, as illustrated in FIG. 21, and the compressed gas chamber 206 is filled with compressed gas 202 through the first compressed gas passage 256.

The second cavity 614 is then filled with the sealing mixture 200 through the fill port passages 616 illustrated in FIG. 36. As the second cavity 614 is filled, the piston 650 is shifted towards the first end 602 of the piston housing 600.

The apparatus 120 is then positioned within the well 6 at a desired location and a signal is sent through the wireline 4, as set out above. The first and second valves 150 and 152 are set to the third operating position, with the compressed gas 202 directed to the injection supply passage 250, as set out above. In this position, the sealing mixture 200 is jetted out of the nozzles 480 at a high pressure and velocity such that it impacts the casing 8 at a high speed, clearing remaining contaminants from the casing wall and promoting adhesion thereto.

When the sealing mixture 200 is depleted from the cavity 610 and the nozzles 480 have been flushed, as set out above, the first and second valves 150 and 152 are set to the fourth position, with the compressed gas 202, scraper passage 264 and injection supply passage 250 all connected to the bleed passage 222, as set out above. In this position, the compressed gas 202 within the apparatus 120 is bled out until it reaches hydrostatic pressure, for safety purposes. The apparatus 120 may then be returned to the surface.

While specific embodiments of the invention have been described and illustrated, such embodiments should be considered illustrative of the invention only and not as limiting the invention as construed in accordance with the accompanying claims.

What is claimed is:

1. An apparatus for preparing a casing of a subterranean well and injecting a sealing mixture into the subterranean well comprising:

an elongate body extending between top and bottom ends, said body connectable to a wireline at said top end thereof and having a plurality of nozzles extending through said body proximate to said bottom end thereof;

a plurality of scrapers positioned within said body, each having a first position retracted within said body and a second position radially extended from said body engageable with the casing;

a cavity within said body operable to be filled with a predetermined quantity of the sealing mixture therein before being located within the well; and a piston slideably movable within said cavity so as to eject the sealing mixture through said plurality of nozzles.

2. The apparatus of claim 1 wherein said piston divides said cavity into first and second chambers.

3. The apparatus of claim 1 wherein said cavity includes a retention means selectably fluidically connected with said plurality of nozzles.

4. The apparatus of claim 3 wherein said retention means is selected from a group consisting of a check valve, a flap valve and a breakable seal.

5. The apparatus of claim 2 further comprising a compressed gas tank within said body.

6. The apparatus of claim 5 wherein said compressed gas tank is fluidically connected to a valve assembly.

7. The apparatus of claim 6 wherein said plurality of scrapers include a plurality of radial pistons selectably fluidically connected to said compressed gas tank through said valve assembly.

8. The apparatus of claim 7 wherein said plurality of radial pistons are operable to extend said plurality of scrapers between said first position and said second position.

9. The apparatus of claim 6 wherein said compressed gas tank is selectably fluidically connected through said valve assembly to said first chamber.

10. The apparatus of claim 6 further comprises at least one motor within said body, said at least one motor operable to selectably move said valve assembly.

11. The apparatus of claim 10 wherein each said at least one motor comprises a step motor.

12. The apparatus of claim 10 further comprises a control circuit connected to said wireline and to said at least one motor.

13. The apparatus of claim 12 wherein said control system comprises a processor.

14. The apparatus of claim 9 wherein said piston includes a bypass passage therethrough operable to selectively connect said first chamber with said second chamber.

15. A method for preparing a casing of a subterranean well and sealing the subterranean well comprising:

positioning a body having a cavity therein in the subterranean well at a location to be sealed at the end of a wireline;

extending a plurality of scraper assemblies from said body thereby engaging said plurality of scraper assemblies with the casing;

displacing said body within the well so as to engage said plurality of scraper assemblies against a length of the casing;

retracting said plurality of scraper assemblies;

positioning said body in the subterranean well at said location to be sealed; and slideably displacing a piston within said cavity of said body so as to eject a predetermined quantity of a sealing mixture located within said cavity before being located within the well through a plurality of nozzles fluidically connected to said cavity and located through said body.

16. The method of claim 15 further comprising:

prior to ejecting said sealing mixture, slideably displacing said piston within said cavity of said body so as to eject a cleaning fluid contained within said cavity through said plurality of nozzles;

removing said body from the subterranean well and filling said cavity of said body with said sealing mixture; and positioning said body in the subterranean well at said location to be sealed.

17. The method of claim 15 wherein said piston is displaced by introducing a compressed gas to said cavity on an opposite side of said piston from said plurality of nozzles.

18. The method of claim 17 wherein said compressed gas is contained within a gas tank in said body with a valve assembly operable to selectably connect said gas tank with said scraper assemblies and with said cavity on said opposite side of said piston from said plurality of nozzles.

* * * * *